US008516834B2

(12) United States Patent
Snow et al.

(10) Patent No.: US 8,516,834 B2
(45) Date of Patent: Aug. 27, 2013

(54) APPARATUS AND METHODS FOR IMPROVING VIBRATION ISOLATION, THERMAL DAMPENING, AND OPTICAL ACCESS IN CRYOGENIC REFRIGERATORS

(75) Inventors: David Snow, Bozeman, MT (US); Michael Chase, Bozeman, MT (US); Alex Woidtke, Bozeman, MT (US); Luke Mauritsen, Belgrade, MT (US); Isaac Henslee, Bozeman, MT (US); Peter B. Sellin, Bozeman, MT (US); Kris Merkel, Bozeman, MT (US)

(73) Assignee: S2 Corporation, Bozeman, MT (US)

( * ) Notice: Subject to any disclaimer, the term of this patent is extended or adjusted under 35 U.S.C. 154(b) by 545 days.

(21) Appl. No.: 12/461,529

(22) Filed: Aug. 14, 2009

(65) Prior Publication Data

US 2010/0050661 A1 Mar. 4, 2010

Related U.S. Application Data

(60) Provisional application No. 61/136,138, filed on Aug. 14, 2008.

(51) Int. Cl.
*F25B 19/00* (2006.01)

(52) U.S. Cl.
USPC ..... 62/51.1; 62/55.5; 62/296

(58) Field of Classification Search
USPC ..... 62/51.1, 48.3, 55.5, 296, 295, 297, 62/259.1; 417/901; 220/560.05, 560.12; 248/636, 638; 378/140, 141
See application file for complete search history.

(56) References Cited

U.S. PATENT DOCUMENTS

| | | | | | |
|---|---|---|---|---|---|
| 3,781,733 | A | * | 12/1973 | Heim | 335/216 |
| 3,894,403 | A | | 7/1975 | Longsworth | |
| 4,161,747 | A | | 7/1979 | Frosh et al. | |
| 4,219,588 | A | * | 8/1980 | Longsworth | 427/160 |
| 4,279,127 | A | * | 7/1981 | Longsworth | 62/77 |
| 4,394,819 | A | | 7/1983 | Averill | |
| 4,696,169 | A | | 9/1987 | Niemann et al. | |
| 4,854,131 | A | | 8/1989 | Sakitani et al. | |
| 4,869,068 | A | | 9/1989 | Van Vloten | |
| 4,990,782 | A | * | 2/1991 | Wellman et al. | 250/352 |
| 5,077,637 | A | | 12/1991 | Martorana et al. | |
| 5,129,232 | A | | 7/1992 | Minas et al. | |
| 5,176,001 | A | | 1/1993 | Taylor et al. | |
| 5,235,818 | A | * | 8/1993 | Horikawa et al. | 62/51.1 |
| 5,317,879 | A | | 6/1994 | Goldberg et al. | |
| 5,327,733 | A | | 7/1994 | Boolchand et al. | |
| 5,381,666 | A | * | 1/1995 | Saho et al. | 62/47.1 |
| 5,446,433 | A | | 8/1995 | Laskaris et al. | |
| 5,530,413 | A | | 6/1996 | Minas et al. | |
| 5,889,456 | A | * | 3/1999 | Triebe et al. | 335/300 |
| 7,278,278 | B2 | * | 10/2007 | Wowk et al. | 62/371 |
| 7,430,871 | B2 | * | 10/2008 | Strobel | 62/51.1 |
| 2003/0106326 | A1 | * | 6/2003 | Sekimoto et al. | 62/51.1 |
| 2005/0126187 | A1 | | 6/2005 | Li et al. | |
| 2005/0188705 | A1 | * | 9/2005 | Jones et al. | 62/86 |
| 2005/0196284 | A1 | * | 9/2005 | Gaudet et al. | 417/44.1 |
| 2005/0223715 | A1 | * | 10/2005 | Kim | 62/6 |
| 2006/0010881 | A1 | * | 1/2006 | Gustafson | 62/47.1 |
| 2007/0044486 | A1 | * | 3/2007 | Wyatt et al. | 62/51.1 |
| 2007/0108974 | A1 | * | 5/2007 | Machi et al. | 324/244.1 |
| 2007/0114233 | A1 | * | 5/2007 | Immel et al. | 220/560.05 |

* cited by examiner

*Primary Examiner* — Mohammad M Ali
(74) *Attorney, Agent, or Firm* — Miles & Stockbridge, PC

(57) ABSTRACT

A cryogenic apparatus is provided having a nested thermally insulating structure, thermal links, a vacuum shroud, and a cryo-cooler. The nested thermally insulated structure holds a sample to be cooled while dampening the external vibrations caused by the cryo-cooler, the surrounding environment or cryo-cooler mounting surface. A vacuum plate is removably attached to the vacuum shroud to provide access to the sample chamber.

35 Claims, 22 Drawing Sheets

APPARATUS AND METHODS FOR IMPROVING VIBRATION ISOLATION, THERMAL DAMPENING, AND OPTICAL ACCESS IN CRYOGENIC REFRIGERATORS

CROSS REFERENCE TO PROVISIONAL APPLICATION

This application is based upon and claims the benefit of priority from Provisional U.S. Patent Application 61/136,138 filed on Aug. 14, 2008, the entire contents of which are incorporated by reference herein.

BACKGROUND

1. Technical Field

The present disclosure relates to the field of low temperature refrigeration. Particularly, this disclosure relates to low-vibration cryogenic devices and methods of use.

2. Background

Cryo-coolers are devices designed to cool samples to cryogenic temperatures, so that a user can use or make measurements on a cold sample.

One class of cryo-coolers achieve cooling of a sample by dripping or venting liquid helium onto a cold finger sample mount plate, where the sample is in vacuum, or alternatively, in a chamber of cold helium gas which surrounds the sample mount. The action of boiling off liquid helium effectively cools the sample to temperatures near or below 4 degrees Kelvin (4 K). Helium gas is then vented off into the atmosphere. This type of cryo-cooler is called an open-cycle cryo-cooler because of the fact the system has to be constantly fed helium for continuous operation. Helium is supplied to these systems through a transfer line from a dewar that contains liquid helium, or where there is a dewar above the sample mount. These systems inherently have little or no vibrations induced on the sample, which would only be induced by the dripping helium, or the external surroundings, however, open-cycle cryo-coolers are hard to maintain, and depend on an external continuous supply of liquid helium, which is hard to distribute and handle and is becoming increasingly expensive as helium is a non-renewable resource only attainable from mining, or as bi-products of other manufacturing processes. Open-cycle cryo-coolers also require somewhat constant maintenance in the delivery of the helium supply to the cryostat which is monitored and controlled.

To overcome the deficiencies of open cycle cryo-coolers, a class of cryo-coolers referred to as cryo-refrigerators or closed-cycle cryo-coolers have been developed. These are thermo-mechanical devices which provide cooling to a cold finger through the pressure cycling of helium gas. These systems require only a single charge of helium gas, which is then pressure-cycled in an ongoing refrigeration cycle. Cryogenic temperatures can vary, but are typically defined to be <4K for a class of cryo-cooler which use circulating helium gas as the coolant. These systems operate on steady wall power, and will run continuously without maintenance for intervals on the order of ten-thousand hours. Closed-cycle cryo-coolers are thus much more reliable over longer periods of time than open-cycle cryo-coolers, do not require an expensive liquid helium supply, and can operate un-attended.

However, while these cryo-refrigerator systems solve many problems for the end user, they have deficiencies of their own for applications where the measurement or experiment or sample is very sensitive to external perturbations, vibrations and/or acoustic noise. These problems arise with the cryo-refrigerator systems due to the mechanical noise and vibrations created by the pressure and temperature cycling of the cold-head. The vibrations are created by the normal operation of the cold-head, which propagate to the sample through mechanical connections through the cold finger to the sample.

Thus, there exists a need for a closed cycle cryo-cooler configuration in which a sample of choice can be cooled to cryogenic temperatures, but without having a direct coupling to the vibrations of the cold-finger, for sensitive and cryogenic applications. These deficiencies are not known to have been overcome in the prior art.

A number of attempts have been made to isolate vibrations of a closed-cycle cryo-cooler from a test sample. One attempt outlined in U.S. Pat. No. 5,327,733 seems to have improved vibration isolation, however the size of the apparatus and specialization of the lab required to accept such an apparatus is relatively large. This apparatus requires separate support structures, which in their preferred embodiment comprises a stiff structure protruding from a ceiling of a laboratory to support the cryo-cooler expander unit, while a similar support structure is mounted on a laboratory table specially designed to dampen vibrations, and accept the lower portion of the structure, which supports the sample. The table is filled with granular material to further dampen vibrations. This entire structure and included support hardware would be extremely hard to move, and if a move did happen modification of a laboratory at the new location would be required. The described design also has multiple independent supports for the entire system.

U.S. Pat. No. 4,854,131 describes a vibration isolation system which has a support structure supported by the same flange that supports the cryo-cooler. This would allow vibrations to travel directly from the cold head to the supported sample. This patent also includes a Joule-Thomson cooler attached to the end of a conventional closed cycle cryo-cooler, which creates a more complex system than needed to achieve temperatures of 15 K or lower.

In U.S. Pat. No. 3,894,403 a vibration isolation system is described which is similar to U.S. Pat. No. 5,327,733 in its structure for supporting the sample. These two inventions use a convective gas such as helium to transfer the thermal energy from the sample to the cryo-cooler. The use of gas or liquid to transfer thermal energy is not feasible in certain situations such as remote installations due to supply problems, for example on a ship or submarine.

Another example of an attempt at vibration isolation of a sample is found in U.S. Pat. No. 5,129,232 where a sample is connected to the cold-finger with strap links. The sample is not supported except through the flexible thermal links. This system is missing a support structure designed to stabilize the sample.

Two U.S. Pat. Nos. 4,394,819 and 4,161,747 describe a sample directly coupled to a stable reference plane. One mounts the cryo-cooler in a floated position that allows movement of the cryo-cooler, while the second is solidly mounted. The floated mount style can have good vibration dampening, however, it is not robust for remote installations, especially when multiple isolator pads and bellows have to be maintained, and is therefore not suitable for applications requiring reliability, such as on a ship or submarine. Both systems use a support structure, however, U.S. Pat. No. 4,394,819 does not mention what the structure is, while U.S. Pat. No. 4,161,747 mentions Nylon rods with copper spacers to create a support structure.

Regarding the thermal links, U.S. Pat. No. 4,869,068 uses a single piece of folded, thermally conductive material to transfer heat while allowing motion. This disclosure is insufficient, however, as the stiffness is significantly higher in this geometry than otherwise possible by using multiple elements to transfer thermal energy.

Conventional thermal links are typically made from multiple elements of thermally conductive material, stacked to form a single thermal connection, as in U.S. Pat. No. 5,129,232. This type of thermal link provides some flexibility in three orthogonal directions, however, the stiffness is only minimized in one direction, and even this minimized stiffness is less flexible than otherwise possible.

Thermal links using wires oriented in a twisted orientations are disclosed in U.S. Pat. No. 5,317,879. These thermal links serve to provide similar flexibility in any three orthogonal directions, however, the twisted orientation of the wires cause binding and causes interaction between individual wires, making it less flexible. Thermal links that use braided wires exist, as in U.S. Pat. No. 4,854,131, however, are similarly disadvantageous as the wires bind on each other due to the braded wire orientation.

A thermal connection is also disclosed in U.S. Pat. No. 5,077,637, which utilizes wires in a housing. Disadvantageously, the housing material limits the flexibility of the thermal connection, making it undesirably stiff.

SUMMARY

In order to overcome the above mentioned problems, this disclosure identifies a cryogenic apparatus comprised of a nested thermally insulating structure, thermal links, a vacuum shroud, and a cryo-cooler. The nested thermally insulated structure (referred to hereinafter as the NTIS) is for holding a sample to be cooled, and the thermal link connects the nested thermally insulated structure and the cryo-cooler. The goal is to cool the sample while dampening the external vibrations caused by the cryo-cooler and the surrounding environment or cryo-cooler mounting surface, also referred to hereinafter as the common mounting reference plane. Thus, the sample when connected to the cryo-cooler is cold and has the additional attribute of having low vibration, despite the fact that the cryo-cooler itself has appreciable vibrations.

In some embodiments of the present disclosure, the nested thermally insulated structure comprises a sample mount for holding the sample to be cooled by the cryo-cooler. The sample mount is optionally tapped with screw holes to allow for a connection of samples. The sample mount is attached to an inner thermally insulated tube, which is then attached to a middle thermally insulated tube via a first tube coupler. The NTIS also comprises an outer thermally insulated tube attached to the middle thermally insulated tube via a second tube coupler.

The NTIS is constructed in a folded arrangement such that the middle thermally insulated tube surrounds the inner thermally insulated tube such that a point midway between the top and bottom of the inner thermally insulated tube is disposed between the top and bottom of the middle thermally insulated tube. Similarly, the outer thermally insulated tube surrounds the middle thermally insulated tube such that a point midway between the top and bottom of the middle thermally insulated tube is disposed between the top and bottom of the outer thermally insulated tube.

The cryogenic apparatus optionally comprises a mount flange attached to an outer surface of the outer thermally insulated tube to connect the NTIS to a vacuum shroud. In another embodiment, the cryogenic apparatus further comprises a tubular radiation shield disposed between the outer thermally insulated tube and the middle thermally insulated tube and the tubular radiation shield is attached to the second tube coupler. The tubular radiation shield may be removably attached or permanently attached to the tube coupler.

Optionally, the NTIS may have only two tube portions, an inner thermally insulated tube attached to the sample mount, and an outer thermally insulated tube attached to the inner thermally insulated tube via a tube coupler. In this embodiment, the outer thermally insulated tube surrounds the inner thermally insulated tube such that a point midway between the top and bottom of the inner thermally insulated tube is disposed between the top and bottom of the outer thermally insulated tube. A tubular radiation shield is disposed between the outer thermally insulated tube and the inner thermally insulated tube, wherein the tubular radiation shield is attached to the tube coupler.

In other embodiments, the NTIS may have any number, N, of thermally insulated tubes, with N−1 tube couplers.

The components of the cryogenic apparatus are comprised of suitable materials to optimize the thermal and vibration-dampening properties. For example, the inner thermally insulated tube, the middle thermally insulated tube and the outer thermally insulated tube comprise glass fiber and epoxy resin. Optionally, they are comprised of carbon fiber, graphite, poly-N,N'-(p,p'-oxydiphenylene pyromellitimide), or polyaryletheretherketone. The sample mount comprises copper and the tubular radiation shield, the first tube coupler and the second tube coupler comprise aluminum. Each of the joints for the elements of the nested structure may be attached with the use of epoxy. Of course, other materials known in the art to be suitable for low temperature refrigeration are useable as well.

In other embodiments, the cryo-cooler of the cryogenic apparatus comprises a cold head, a high temperature cold finger in communication with the cold head, a low temperature cold finger in communication with the high temperature cold finger; and a cryo-cooler radiation shield.

The thermal link has a high temperature thermal link portion and a low temperature thermal link portion such that the high temperature thermal link portion connects the second tube coupler with the high temperature cold finger, and the low temperature thermal link portion connects the sample mount with the low temperature cold finger. In addition, the cryo-cooler radiation shield connects the high temperature cold finger and the high temperature thermal link portion.

In another embodiment of the present disclosure, the thermal link comprises a plurality of wires. The thermal link has greater than 1000 wires. Optionally, the thermal link has greater than 10,000 wires. Each wire comprises a thermally conducting metal, such as copper, although any suitable conductive metal may be used. Each of the wires has a diameter of from 0.001 inches to 0.005 inches.

In the present disclosure, the thermal link reduces vibration in the cryogenic apparatus such that a peak corresponding to a repetition interval at which the cryo-cooler operates is lowered from 10 μm to 20 nm.

In another embodiment of the present disclosure, the cryogenic apparatus comprises a vacuum shroud encasing the NTIS, the cryo-cooler, and the thermal link. A vacuum plate is removably attached to the vacuum shroud such that the outer thermally insulated tube, the sample mount, and the vacuum plate form a sample chamber. The sample chamber is not in fluid communication with an area enclosed by the vacuum shroud, such that upon dispersal of the vacuum in the sample chamber, a vacuum can be maintained in the area enclosed by the vacuum shroud.

The cryogenic apparatus optionally comprises a removable radiation shield removably attached to the tubular radiation shield, and the removable radiation shield is not in direct contact with the vacuum plate.

Optionally, the cryogenic apparatus is structured such that a portion of the inner thermally insulated tube, a portion of the middle thermally insulated tube, a portion of the outer thermally insulated tube, and a portion of the tubular radiation shield are transparent to light. For example, optical access is provided by including apertures in parts of the NTIS, which can be accessed and accommodated by optical windows in the vacuum shroud. The orientation of the NTIS with respect to the vacuum shroud allows access to the sample space to be accessed from the bottom, the top or the side with respect to the user.

The cryogenic apparatus has various novel attributes including, but not limited to, its compact nested design which reduces its overall volume, the use of joints between different materials that reduces its flexibility and thus increases its structural stability, its insulating ability to connect to very cold and very warm parts and maintain a temperature gradient across materials, its ability to maintain a vacuum in the sample mounting volume, and its ease of access to the sample mounting region from a detachable access plate. NTIS connects directly to a common reference plane as does the cryo-cooler through a mount flange.

Additional advantages and other features of the present disclosure will be set forth in part in the description which follows and in part will become apparent to those having ordinary skill in the art upon examination of the following or may be learned from the practice of the disclosure. The advantages of the disclosure may be realized and obtained as particularly pointed out in the appended claims.

As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

DETAILED DESCRIPTION OF ILLUSTRATIVE EMBODIMENTS

Figure 1:
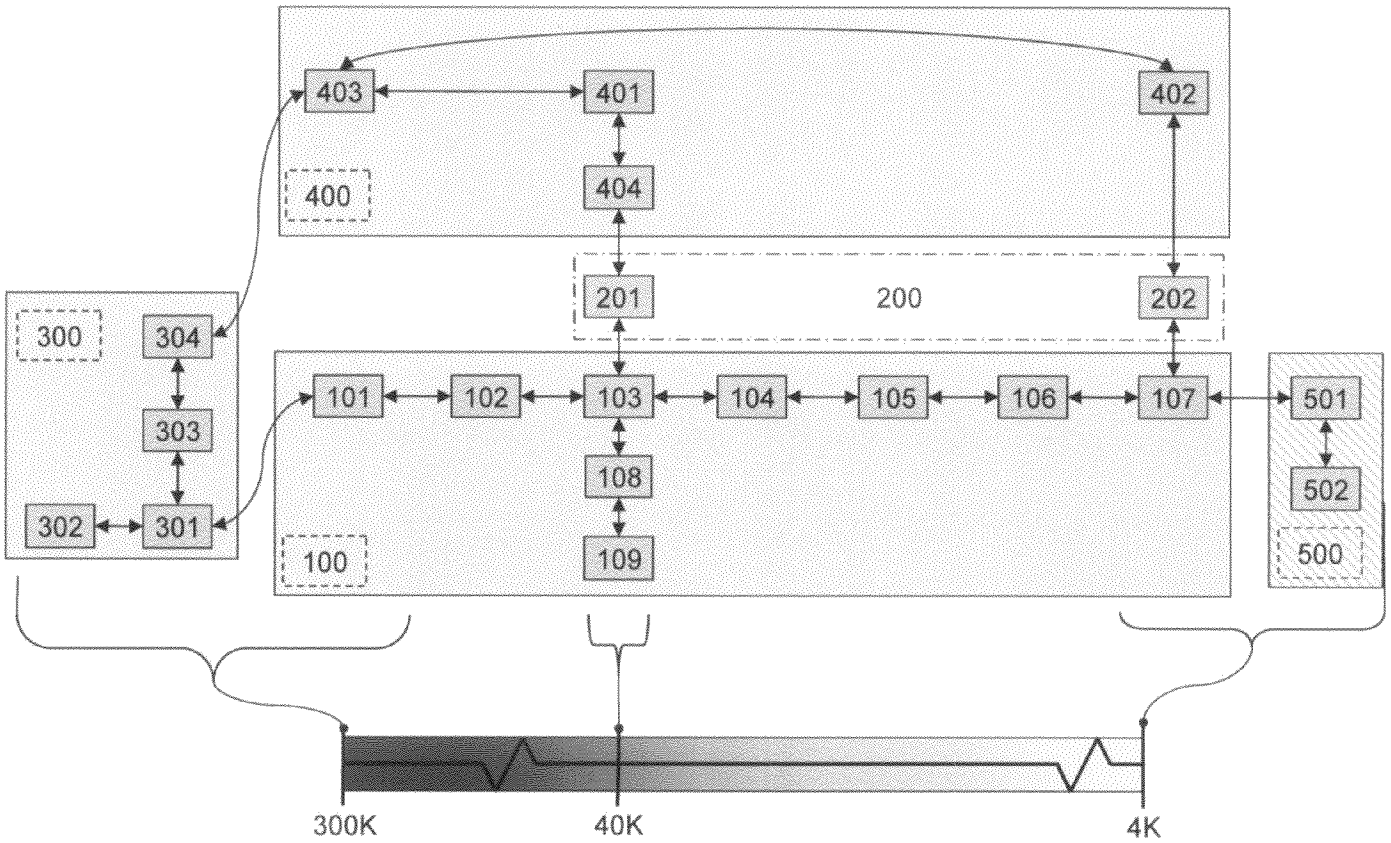
FIG. 1 is a block diagram representing an overview of a system according to an embodiment of the present disclosure.

A block diagram representing subassemblies and individual components of each subassembly of the present disclosure, is shown in FIG. 1. The components are the nested thermally insulated structure (NTIS) 100, the thermal links 200, the vacuum shroud 300, the cryo-cooler 400, and the sample 500.

Figure 2:
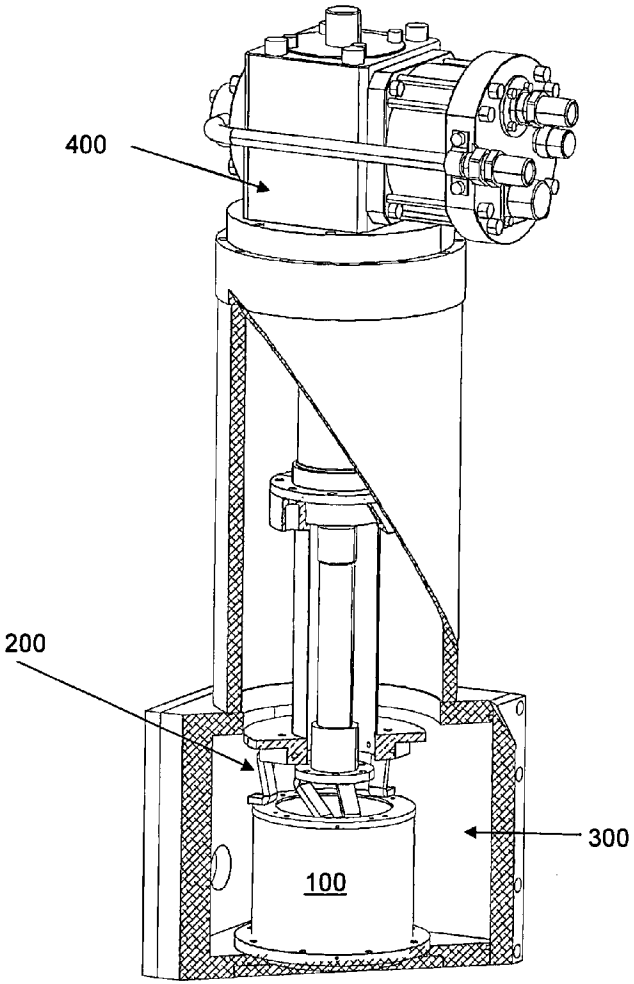
FIG. 2 is a partial cutaway view of a system according to an embodiment of the present disclosure.
Figure 4:
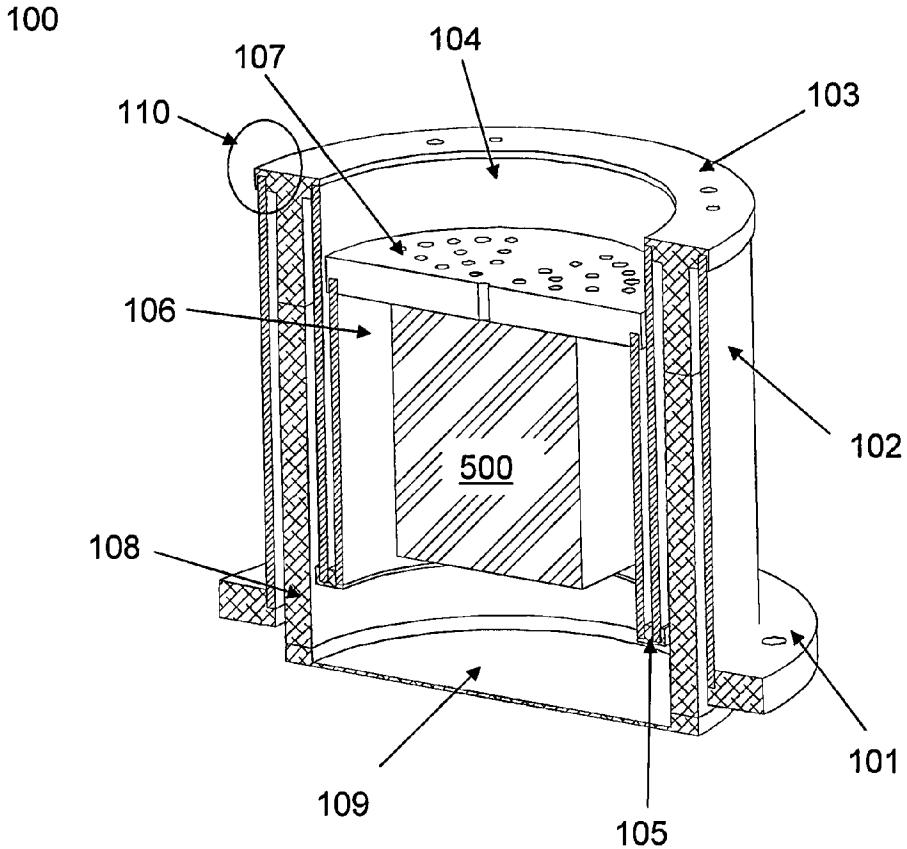
FIG. 4 is a cutaway view of a nested thermally insulating structure (NTIS), for vibration dampening a sample attached to a cold finger according to an embodiment of the present disclosure.

FIG. 2 shows a high level overview of the NTIS 100, the thermal links 200, the vacuum shroud 300, the cryo-cooler 400. The sample 500 is not shown, but is attached inside of the NTIS 100, as shown in FIG. 4.

The disclosed system typically has four main groups of components. Each component serves a specific role that aids in the overall operation of the system. These groups are outlined individually and then collectively.

Cryogenic Refrigerator 400

The cryogenic refrigerator 400 serves to facilitate the transfer of heat energy out of the cryostat. There are many different types of cryogenic refrigerators, however, they all serve to extract heat from the sample and other components within the cryostat, thus allowing the components to reach the desired temperature. The cryo-cooler 403 is a mechanical device which provides pressure cycling of Helium gas, when combined with a compressor and gas transfer lines (not shown) to circulate Helium gas to the coldfinger stages where it expands and produces cooling before circulating back to the compressor.

The present disclosure may be applied to all types of conventional cryo-refrigerators. While in this description of the present disclosure, one class of cryo-coolers is discussed, it is not limited to this class.

Figure 3:
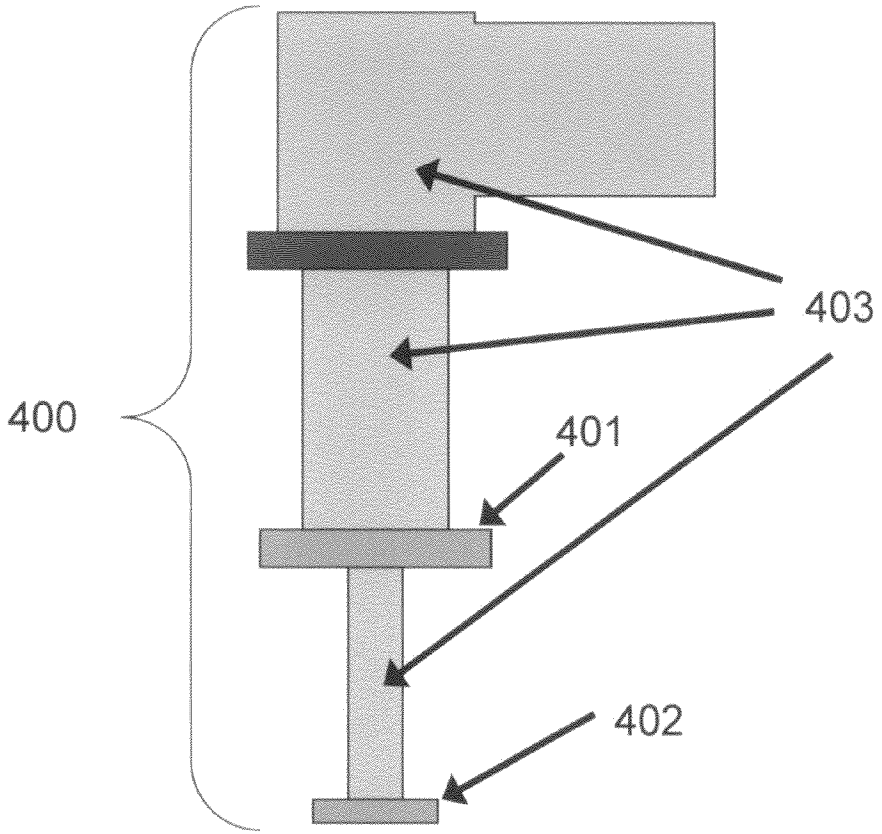
FIG. 3 is a representation of a cryogenic refrigerator usable in the system.

In one embodiment of the present disclosure, a two stage cryo-cooler 400 used to achieve <4K operation is shown in FIG. 3. The temperature each stage can reach depends upon the heat load at that stage. The first stage, a high-temperature cold finger 401, is generally warmer than the second stage, a low-temperature cold finger 402, but can handle significantly higher thermal loads. The high-temperature stage generally handles the majority of the thermal load on the system from the components at room temperature. This stage typically achieves temperatures of about 40K. The second stage 402 is where a cold sample is typically mounted, as it achieves the ultimate low temperature for the system. These temperatures are generally around or below 4K. Specific temperatures of 40K and 4K are used throughout, however, these are general parameters and vary between cryogenic systems.

Sample 500

A sample can be any object of interest to be mounted and cooled to cryogenic temperatures, within the physical constraints of the sample mounting space as provided by the present disclosure, which the user desires to be cryogenically cooled and to have significantly reduced displacement or mechanical vibration levels. Examples include but are not limited to superconducting electronic chips, spectroscopic material samples, photodetectors, crystals, etc. The sample 502 is typically connected to the sample mounting plate 107 via a mechanical connection apparatus 501.

Nested Thermally Insulating Structure 100

The nested thermally insulating structure 100 (NTIS) is a rigid thermally insulating structure comprised of several jointed materials, which serves as the connection apparatus between the cryo-cooler 400 to a sample 500 via metallic contact points to thermal links 200 and a vacuum shroud 300.

Advantages of the disclosed NTIS include, but are not limited to, a compact nested design which reduces the overall volume of the nested structure, the use of joints between different materials that reduces flexibility and thus increases structural stability, insulating ability to connect to very cold and very warm parts and maintain a temperature gradient across materials, ability to maintain a vacuum in the sample mounting volume, and ease of access to the sample mounting region 500 from a detachable access plate. When free space apertures are used in some parts, the vacuum will not be maintained when material is removed leaving a hole. However, if holes are created and then filled with a vacuum tight transparent material (i.e., windows with sealed joints) the vacuum will be maintained.

The NTIS 100 is designed to operate with a temperature gradient across it, so that some parts of the assembly are at room temperature (i.e., 300 K), and other parts at a cryogenic temperature (i.e., 4K), and the gradient across the parts between them creates an effective mode of operation. The nested design takes the layers of a thermally insulating material or materials and "folds" them to create a compact stiff structure. This reduces vibrations from external sources by having the sample mount 107 as close to the reference support 501, shown in FIG. 6, as possible. If the NTIS 100 were unfolded to create a stiff tower instead of a nested structure, the vibrations would be larger due to the higher moment forces on the structure.

The nested structure is designed to maintain low thermal conductivity, while at the same time keeping stiffness as high as possible to maintain low vibrations. Materials suited well for the thermally insulating material 102, 104, 106 include glass fiber and epoxy resin (G-10 Fiberglass™), polyaryletheretherketone (PEEK), glass ceramics such as Macor™, carbon fiber (Avia Fiberglass™), poly-N,N'-p,p'-oxydiphenylene pyromellitimide (Vespel™) and other such materials with low thermal conductivity and high stiffness, in a readily available form that is readily manufactured or machined.

Metallic parts as described are chosen and used such that they provide good thermal conductivity, and are rigid, and typically are chosen so that they are not too heavy, relatively cheap and easy to machine, when possible. For example, copper is a good metal for some of the parts, but can be difficult to machine and is heavy and more expensive. Copper is thus used for parts like the mounting plate 107, and for the radiation shield 108 where very high thermal conductivity is needed. Oxygen free high conductivity (OFHC) copper is used. For the other metallic parts, aluminum is often chosen since it is rigid, relatively cheap and easy to machine. Other metal choices could be but are not limited to stainless steel or copper.

An embodiment of the NTIS 100, the materials used, and the connections to other parts, both externally to other subassemblies and internally to the NTIS 100 will now be described.

Figure 10B:
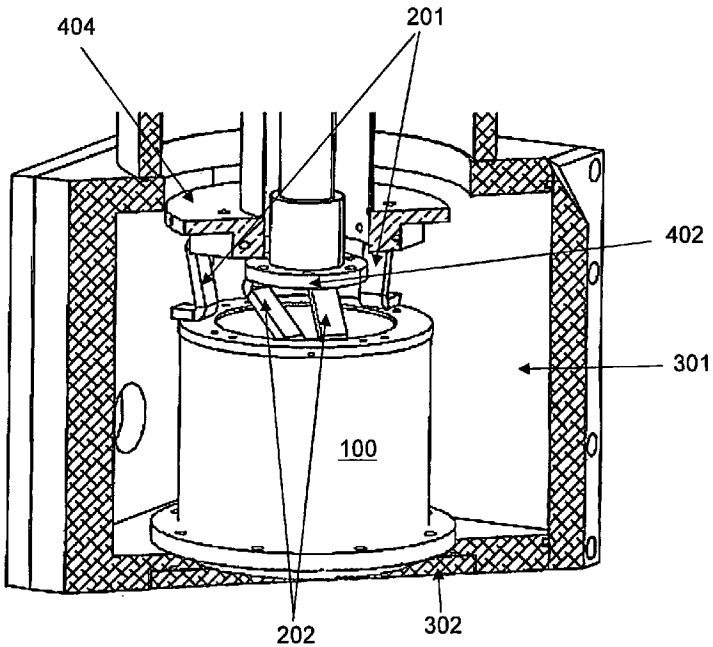
FIGS. 10A-B and 11 are cutaway views of a vibration assembly and cryo-cooler according to an embodiment of the present disclosure.
Figure 10A:
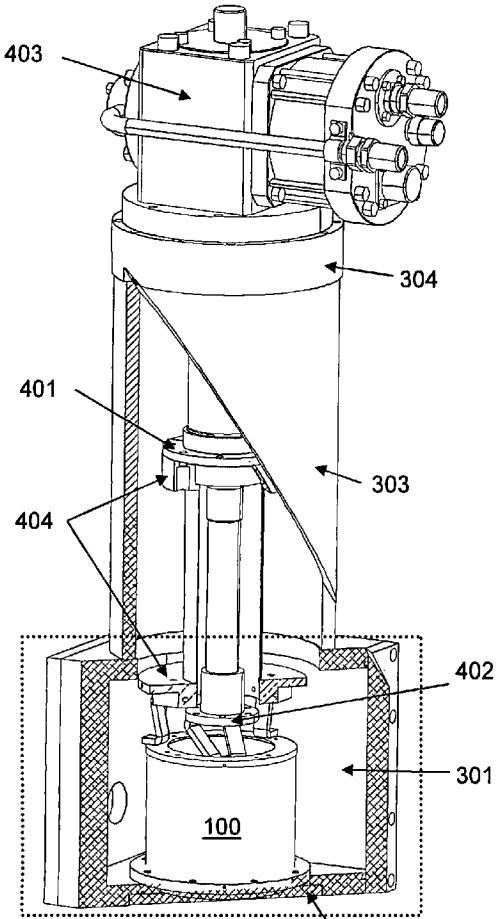

As shown in FIGS. 10A-B, the NTIS 100 connects to a cryo-cooler 400 via the thermal links 200 as follows: high-temperature thermal link portions 201 link one tube coupler 103 to the high-temperature cold finger 401. In addition, the sample mount 107 is linked to the low-temperature cold finger 402 via the low-temperature thermal link portions 202, and is supported by vacuum shroud 300.

Figure 7:
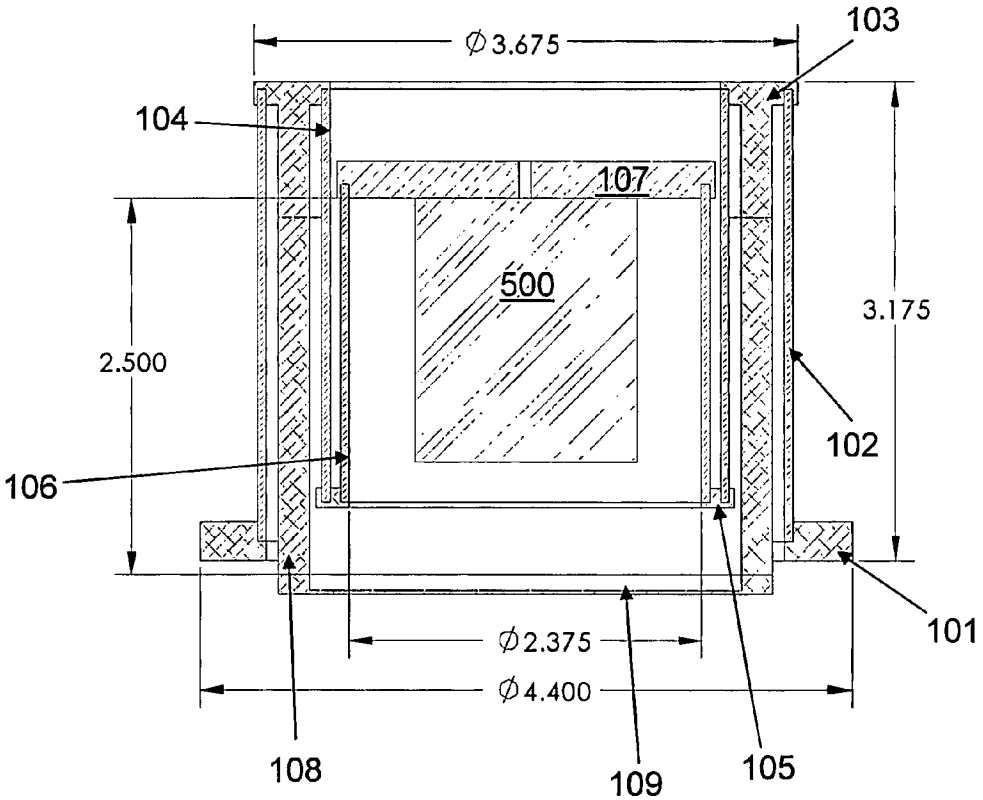
FIG. 7 is a cross section of a nested thermally insulating structure according to an embodiment of the present disclosure.

As shown in FIG. 7, the NTIS mount flange 101 is a metallic structure (e.g., aluminum) that allows the entire NTIS 100 to be secured to a reference plane. The mount flange 101 is connected to the outer thermally insulated tube 102, and is attached via epoxy bondings. In addition, the outer thermally insulated tube 102 is attached to the tube coupler 103, which also has a metallic structure.

In total, three parts within the NTIS 100, specifically the outer thermally insulated tube 102, the middle thermally insulated tube 104 and the inner thermally insulated tube 106, are each connected and secured to metallic flanges by means of epoxy bonds 110 (see, FIG. 6) with high coefficient of thermal expansion (CTE) materials outside of lower CTE materials.

Turning back to FIG. 7, the mount flange 101 at 300 K is connected to the outer thermally insulated tube 102 via epoxy bonding. The outer thermally insulated tube 102 has a temperature gradient throughout its length, and then supports the radiation shield mount, also called a tube coupler 103 via epoxy bonding. FIG. 10B shows the radiation shield mount 103 is cooled to 40 K by high-temperature thermal links 201 that are attached to the cryo-cooler radiation shield 404 that is cooled by the high-temperature cold finger 402.

As is shown in FIG. 4, the radiation shield mount 103 is connected to the middle thermally insulated tube 104 via epoxy bonding, where the structure now goes back in the opposite direction, and in doing so, creates an insulating gap. The middle insulating tube part 104 is connected to tube coupler 105 via epoxy bonding. The tube coupler 105 is then connected to the inner thermally insulated tube 106 via epoxy bonding. The inner thermally insulated tube 106 is formed in the opposite direction again, creating a second insulating gap, and then is connected to via epoxy bonding and supports the sample mount 107. Sample mount 107 at 4 K is connected via the low-temperature thermal link portion 202 to the low-temperature cold finger 403, which cools the plate (shown in FIG. 10B). A sample 500 can be mounted to sample mount 107. A radiation shield 108 is used to minimize heat load between the outer and middle structure tubes 104 and 102. Radiation shield, also referred to as tubular radiation shield 108, is at 40 K, and thus reduces heat from radiation. A further removable radiation shield cap 109, at 40 K, is attached at the opening to the NTIS 100 to block any radiation heat loads from the bottom.

During cold operation, there is a temperature gradient on both the middle thermally insulated tube 104 and the inner thermally insulated tube 106 between the radiation shield mount 103 at 40 K and the sample mount 107 at 4 K. Heat is conducted away and is cooled by the low-temperature thermal link portions 202 that are connected to the low-temperature cold finger 403.

Figure 12:
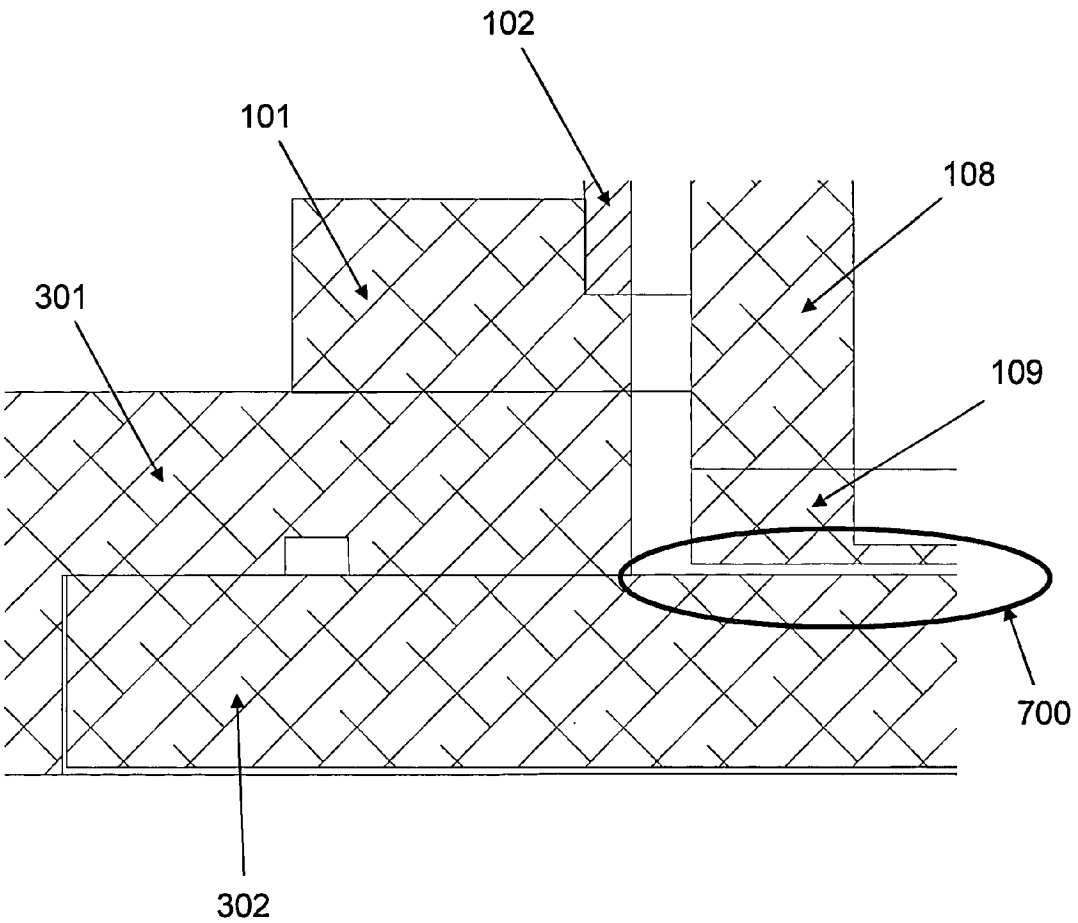
FIG. 12 is a partial cross-sectional view of the gap 700 between the vacuum plate 302 and the removable radiation shield 109 of the apparatus of FIG. 11.

The mount flange 101 is connected to the bottom vacuum housing 301 at 300 K to support the NTIS 100 to a reference plane and house the structure in a vacuum vessel 300 along with the cryo-cooler 400 for cryogenic cooling. A bottom access vacuum plate 302 is attached to the bottom vacuum housing 301 so that the NTIS 100 may be easily accessed. As shown in FIG. 12, there is a gap 700 between the radiation shield cap 109 at 40 K and the bottom access vacuum plate 302 at 300 K so that the temperature differential can be obtained. A top vacuum housing 303 is attached to the bottom vacuum housing 301 and encompasses the cryo-cooler 400. A cold head adapter 304 flange that allows many different cryo-coolers to be adapted to the vacuum vessel 300 is then attached to the top of the top vacuum housing 303 to support the high-temperature cold finger 401.

This embodiment includes an integrated mounting flange 101 which serves to support the other elements via the outer thermally insulated tube 102, which supports the structure for its attachment to a common reference plane of the vacuum shroud 300. However, this is not critical or required for assembly, since the outer thermally insulated tube 102 could connect to the vacuum shroud 400 directly, where a feature like the mount flange 101 can be machined into the cryo-cooler 400. The outer thermally insulated tube 102 can then be attached via epoxy bonding to the modified vacuum shroud 300 at the bottom vacuum housing 301. This feature also allows the NTIS 100 to be removed and re-inserted easily from the cryo-cooler 400. This feature also allows an easy interface with the thermally insulating material, which is normally hard to thread or machine in general.

The NTIS 100 acts as an independent structure. All the mounts for samples and the base mount are included in the structure along with the mounts for thermal links for both the radiation shield (40 K) and cold stage (4 K). The sample mount flange on the NTIS allows for a wide variety of samples to be bolted directly to the mount.

Figure 5:
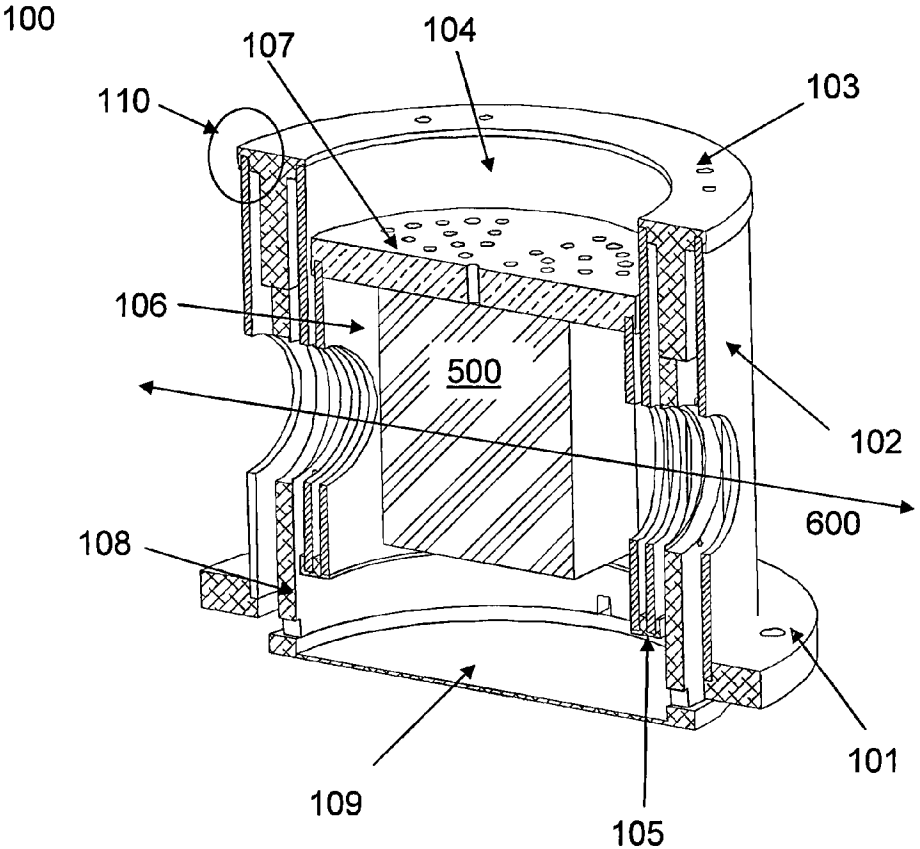
FIG. 5 is a cutaway view of an NTIS with optional optical access according to an embodiment of the present disclosure.

Referring now to FIG. 5, when optical access 600 is required, radiation windows located on the radiation shield 108 are present to shield the sample 500, at 4K, from the surrounding 300K radiation. Also, portions of the tube material are removable to provide optical access. Windows are installable in some, all or none of the parts, depending on the application. A means to install, replace and maintain radiation windows is described for the tubular radiation shield 108. The tubular radiation shield 108 can be accessed by removal of the bottom access vacuum plate 302 and the radiation shield cap 109. The radiation shield mount 103 has pressed-in locating pins so that radiation shield 108 can be removed and then repeatedly located and oriented correctly to the radiation shield mount 103 before the interface is bolted together. The mounting of the tubular radiation shield 108 to the radiation shield mount 103 is achieved via first aligning pins (not shown) that are inside of the joint between the tubular radiation shield 108 to the radiation shield mount 103. Then, pre-drilled counter-bored holes that run nearly the full length of the tubular radiation shield 108 allow for the use of a bolt to secure the tubular radiation shield 108 to pre-tapped threaded holes in the radiation shield mount 103, which enables good thermal contact between the parts. With the tubular radiation shield 108 removed one can also readily access and maintain the radiation windows, as well as to wire additional electrical connections to the sample space.

The sample mount 107 can be custom designed to have many different standard bolt patterns and holes from which to choose. This allows for almost all standard samples to be directly bolted to the sample mount 107 without further modification.

In one embodiment, there is free space optical access 600 provided to the sample space 500. This is shown in FIG. 5. This access allows for free-space optical beams to pass through the sample space in order to interact with the sample 502. This access 600 could also be used for free space illumination, laser beams, microscopes, or simply visual access to the sample. Accordingly, when there are holes in the free space access design, there are also holes in the vacuum shroud 300 with optical window ports which accommodate radiation shield windows. Radiation windows are bolted to the tubular radiation shield 108 with added free space optical apertures ports. The entire NTIS 100 is at the same pressure as the vacuum vessel, therefore if the windows are not used, they do not need to seal for any pressure differential. The outer, middle and inner thermally insulated tubes 102, 104, and 106 are also modified likewise to have open optical apertures.

Figure 6:
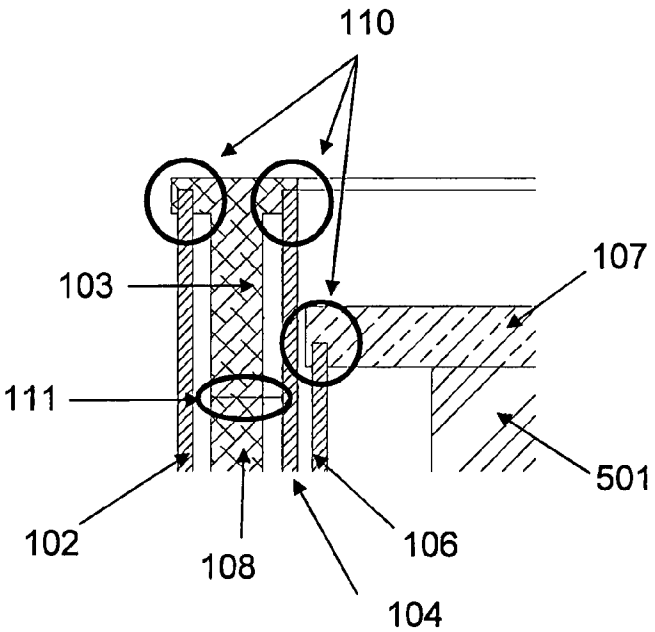
FIG. 6 is a partial cross-sectional view of a capture epoxy joint, where higher CTE material are outside of lower CTE materials according to an embodiment of the present disclosure.

There are many connection joints located in the NTIS which allow for operation at low temperatures and low vibration. An example of an epoxy joint in the structure is shown in FIG. 6. Due to the CTE mismatch between the thermally insulating tubes 102, 104, and 106 and the tube couplers 103 and 105, the joints 110 may be compromised if not designed correctly. All epoxy joints 110 in the NTIS 100 use capture joints, where a capture joint is one where the higher CTE parts are on the outside of the parts with a lower CTE. Thus, capture joints are used to accommodate for a difference in thermal expansion of the materials (i.e., glass fiber/epoxy resin and aluminum). For example, as much as 0.007 inch difference in thermal expansion between these parts occurs between assembly at 300K and operation at 4K. This difference in thermal expansion could lead to separation in the parts and would induce very large stresses on the epoxy bonds in tension, and over many cycles will cause the bonds to fail. The use of capture joints ensures that epoxy bonds will be in compression and will induce less stress than otherwise, and not pull apart the epoxy joint during thermal cycles. Additionally, it is desirable to use an epoxy capable of operating at cryogenic temperatures, and withstanding the shock of several thermal cycles and low outgassing. A typical epoxy used is Masterbond part EP29LPSP.

The connection 111 between the radiation shield mount 103 and the tubular radiation shield 108 as a bolted joint of two pieces of aluminum is shown in FIG. 6.

Figure 22:
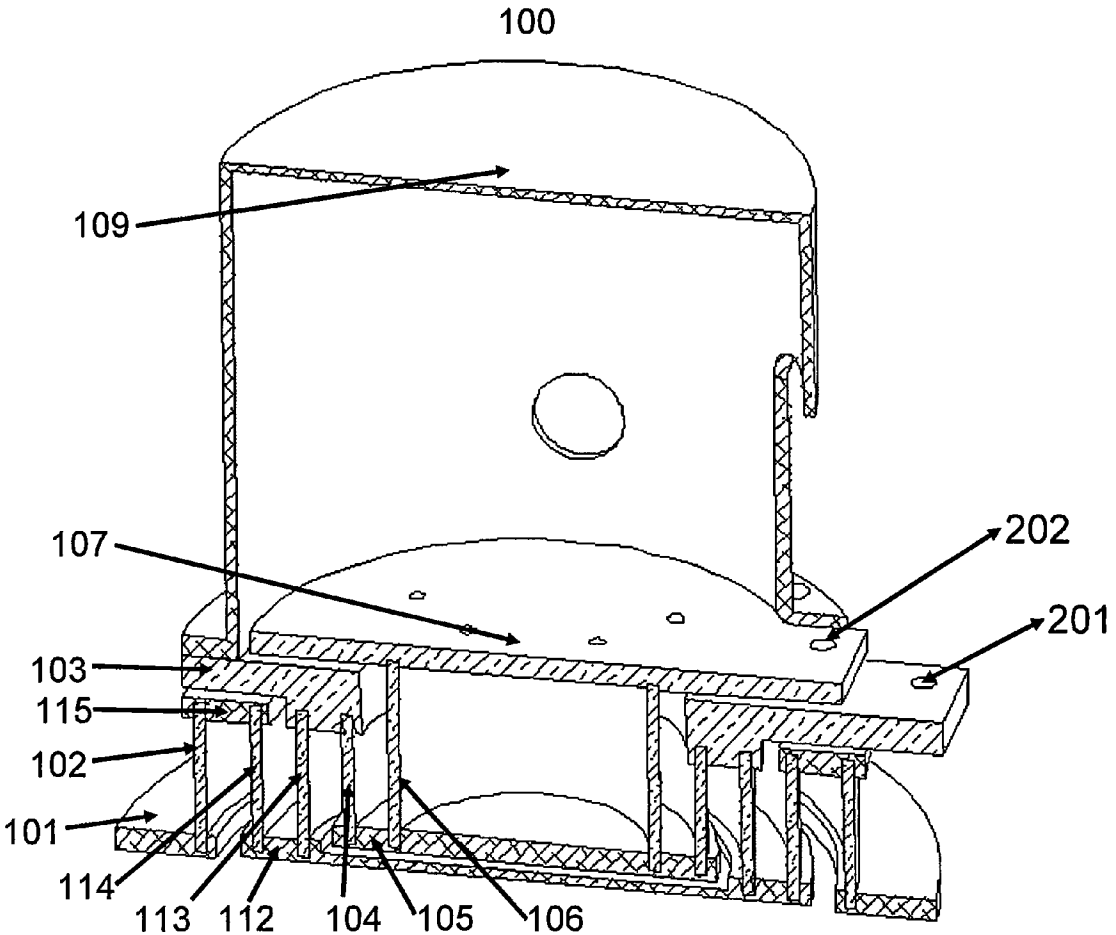
FIG. 22 is a cutaway view of an NTIS having 5 thermally insulated tubes according to an embodiment of the present disclosure.

In other embodiments, the NTIS may have any number, N, of thermally insulated tubes, with N−1 tube couplers. For example, FIG. 22 is a representation of another embodiment of the NTIS which has 5 thermally insulated tube sections and 4 tube couplers. As is shown, an inner thermally insulated tube 106 is attached to the sample mount 107. The tube coupler 105 joins the inner thermally insulated tube 106 with the middle thermally insulated tube 104. An inner intermediate thermally insulated tube 113 is joined to the middle thermally insulated tube 104 via the tube coupler 103 and to an outer intermediate thermally insulated tube 114 via tube coupler 112. The outer intermediate thermally insulated tube 114 is connected to the outer thermally insulated tube 102 via another tube coupler 115. A radiation shield (not shown) may be placed between either the outer thermally insulated tube 102 and the outer intermediate thermally insulated tube 114, between the middle thermally insulated tube 104 and the inner intermediate thermally insulated tube 112, or optionally, in both locations.

Thermal Links 200

The thermal link 200 provides the means of heat transfer while minimizing the transfer of mechanical vibrations from the cryo-cooler 400 to the NTIS 100 and eventually to the sample assembly 500.

The thermal link 200 is in two portions. High-temperature thermal link portion 201 is used to connect the radiation shield mount 103 to the high-temperature cold finger 401, and low-temperature thermal link portion 202 is used to connect the sample mount 107 to the low-temperature cold finger 402. Each thermal link portion 201, 202 can be one or more of the assemblies described in this section. A more flexible thermal link improves the effectiveness of the isolation of mechanical vibrations between the cryo-cooler 400 and sample 500 by simply applying a smaller force on the sample mount 107. This is because more flexible thermal links deflect with less force. The motion of the cryo-cooler 400 vibrating while it runs therefore translates into a smaller force on the sample when softer thermal links are used.

However, there is a fundamental tradeoff between thermal conductivity and stiffness. When thermal links 200 are made longer, or with a smaller cross-sectional area, the thermal links become less stiff and therefore transfer fewer mechanical vibrations. The tradeoff is that this causes the thermal links to transfer less heat over the greater distance. Similarly the thermal links can be made shorter and thicker to accommodate higher rates of thermal transfer but with more mechanical vibrations being coupled through the thermal link.

Proper heat treatment of metallic materials minimizes internal stresses within the material, and maximize the size of grains within the material, thus producing a softer and more thermally conductive material.

The physical geometry of the link plays a key role in its stiffness as well as its thermal conductivity. Thermal links can take many different geometric forms, the most common of which is stacks of thin sheets of thermally conductive material, for example, copper.

The most effective geometry for improving the flexibility of the thermal links is to use groups of very fine wires. The wires are oriented such that minimal twisting, braiding or interweaving of the wires occurs. This allows each individual wire to move independent of the wires surrounding it, thereby minimizing the overall stiffness of the thermal link. The ends of the wire are pressed together using heat and pressure to form solid ends, known as forged ends, which can be used as an attachment point for the thermal link. The forged ends are typically bored with a hole and thus can be mechanically attached using a bolt to a receptive threaded bolt hole in the linking part. Indium foil can be used in the mounting interface, to lower the contact resistance. However, other methods for attaching thermal links known in the art can also be employed.

Figure 8:
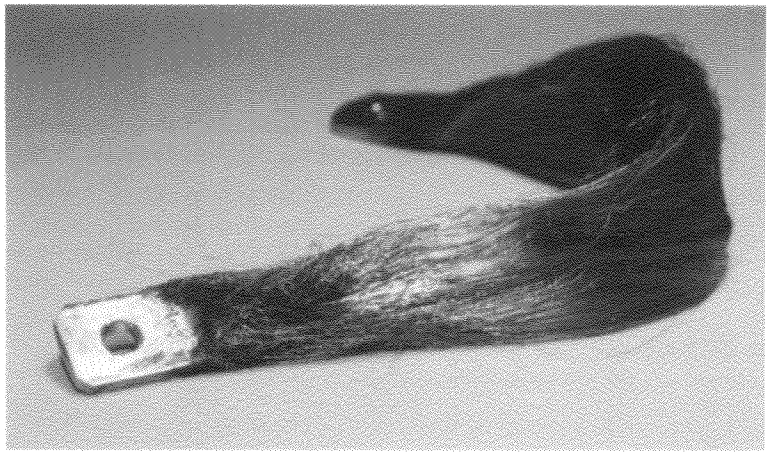
FIG. 8 is a perspective view of a fabricated multi-wire thermal link according to an embodiment of the present disclosure.
Figure 9:
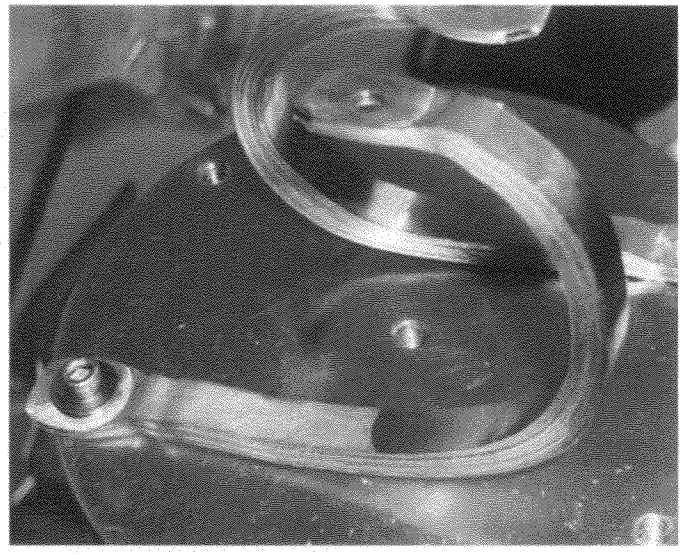
FIG. 9 is a perspective view of a copper strap thermal link usable with an apparatus according to the present disclosure.

Other embodiments of the thermal links for low vibration operation use more than 1000 wires. In one embodiment, approximately 10,000 independent oxygen free high conductivity (OFHC) copper wires, each having a measurement of 44 awg (0.002 inch diameter), are bunched together to make a single thermal link with forged ends. The thousands of small wires produce a thermal link 200 that is significantly more flexible than the strap design as shown in FIG. 9 while transferring heat only slightly less efficiently. An example of a multi-wire link with forged ends is shown in FIG. 8.

Vacuum Shroud 300

The cooled components within the cryostat are held in a vacuum environment maintained by a vacuum shroud 300 as shown in FIG. 10A. The bottom vacuum housing 301 is a main housing for the NTIS 100, and supports the upper vacuum housing 303 and the coldhead 403. The vacuum plate 302 is used to access the sample mounting volume or sample chamber 500. The upper vacuum housing 303 is typically round aluminum tubing which is used to support the cryo-cooler head 403. The adapter plate 304 is made to attach to the upper vacuum housing 303 to adapt the housing to the cryo-cooler cold head 403 that is desired for use. All parts typically operate at a temperature of 300K.

FIG. 10B shows the vacuum plate 302 connected to vacuum housing 301 via bolts that thread into tapped holes in the bottom vacuum housing 301 with counter-bored clearance holes in the vacuum plate 302, and with an o-ring seal and vacuum grease (neither part is shown). The o-ring is fitted into a machine groove in the bottom vacuum housing 301 with tolerances typical for this type of vacuum connection, which will be well known to anyone skilled in the art of vacuum vessels or enclosures. The bottom vacuum housing 301 is also connected to the upper vacuum housing 303 via similar bolts, o-ring seals and vacuum grease with a similar groove for the o-ring. The upper vacuum housing 303 is connected to the adapter plate 304 in the same manner. The adapter plate 304 is connected to the cryo-cooler cold head 403 in the same manner, with a machined o-ring groove in the adapter plate 304, where the other side of the adapter plate 304 is made to accommodate the various choices of cryo-cooler heads that can be used where the bolt pattern has to match up with that supplied by the vendor of the coldhead.

As noted, this entire vacuum shroud assembly 300 also is used as a mechanical support for the cryo-cooler 400 and various internal components. The vacuum environment serves to eliminate heat transfer through the atmosphere that would otherwise be present within the system. In addition, the vacuum environment also eliminates any gas or vapor from the presence of cooled components where it could condense or freeze.

The vacuum housing 300 and the NTIS 100 have universal parts for most commercial-off-the-shelf cryo-cooler heads. This design principle allows for multiple cryo-cooler heads to be fitted to the same vibration isolation system. Multiple cryo-cooler heads can be fitted to the same vibration isolation system with modifications on only three different parts. When changing the cold head over to another type, the transition only requires a modified radiation shield, a new cold head adaptor collar, and a mount for the 4K thermal links. These three parts are relatively easy to manufacture, making conversion simple. This basic setup uses stock aluminum tubing for the top of the vacuum shroud and square tubing for the bottom of the shroud.

The choice of materials for the vacuum shroud 300 are optimized to provide rigidity, low cost, ease of manufacturing, and low weight. These parts do not need to be highly thermally conductive. In one embodiment, the vacuum shroud portions 301-304 are made from aluminum, which is sufficient but not required. Optionally, these parts could be made from plastic, fiberglass composite, stainless steel, and other materials sufficient for vacuum.

The vacuum shroud can also be made to minimize the upper exterior shroud diameter which will help decrease the radiation load on the entire system. This upper vacuum housing 303 can be sized such that it closely contours the exterior dimension of the cryo-cooler 400 so as to minimize radiation heat transfer from the room temperature vacuum shroud 300 and the cooler cryo-cooler 400.

Overview Explanation of Implemented Assembly

A method in which the disclosed cryo-cooler vibration isolation assembly is integrated together will now be described with reference to FIGS. 1, 11 and 12.

The NTIS 100 is attached to the cold head 403 in two places with the use of thermal links 200. The first attachment connects the cryo-cooler radiation shield 404 to a set of high-temperature thermal link portions 201 (typically two or more links) to the tube coupler 103. This provides a sink for the majority of the thermal energy from ambient and cools the tubular radiation shield 108 which surrounds the inner cold sample 500. A second attachment point attaches the sample mount 107 to the low-temperature cold finger 402 with a set of low-temperature thermal link portions 202. This then cools the sample to the colder temperature near or below 4K. The tube couplers 103 and 107 act as permanent mounting points for the thermal links 200 which allow unlimited sample changes without moving or resetting the thermal links 200. Additionally, an indium sheet is used in between all joints of all thermal link attachments (not shown) to minimize the thermal contact resistance. Specifically, this indium is used between the cryo-cooler radiation shield 404 and the high-temperature thermal link portion 201, the high-temperature thermal link portion 201 and the tube coupler 103, the low-temperature thermal link portion 402 and the low temperature thermal link portion 202, and the low temperature thermal link portion 202 and the sample mount 107. This also enables a user to access the sample mount 107 without disconnecting the link connections.

Additionally, in certain embodiments, a NTIS 100 can also be used as an independent vacuum housing to allow for quick sample access without breaking vacuum in the rest of the housing. This allows for convenient user operation. The user can make sample changes quicker since the time to evacuate the relatively small sample mounting volume will be less than if the entire vacuum apparatus was to be contaminated and then re-evacuated. In this embodiment, the following procedures apply, which will be understood by anyone skilled in the art of vacuum vessels and cryo-coolers.

First, prior to assembly and cold operation, heaters are attached to tube coupler 103 and sample mount 107 via electronic connections thru the vacuum vessel. Second, when the cryo-cooler assembly is cold and operational, and it is desired to change samples, the heaters are activated to raise the temperature of the cold components within the NTIS, specifically tube coupler 103 and sample mount 107, to nearly room temperature. A temperature gradient will then result across the sample mount 107 to the low-temperature thermal link portion 402, specifically across the low-temperature thermal link portion 202 and cryo-cooler radiation shield 404. Third, the vacuum held within the NTIS 100, specifically in the sample mounting volume, is contaminated or released by removing vacuum plate 302 and removable radiation shield 109. A certain amount of force will be holding that plate down, so a vacuum release valve (not shown) could be engineered into vacuum plate 302 and removable radiation shield 109, or alternatively, the force could be overcome manually. Fourth, the sample is changed or replaced. Fifth, vacuum plate 302 and removable radiation shield 109 is installed. Sixth, vacuum is reestablished in the sample mounting volume. This could be achieved with a vacuum access and pumping port and valve added to vacuum plate 302 in several different embodiments depending on the orientation of the NTIS 100, and dimensions of the parts used (not shown). Seventh, the heater is turned off and the cryo-cooler and assembly are then able to cool again to cryogenic temperatures.

Alternatively, the same kind of heaters in the same kind of configuration can be used to heat a sample to temperatures >4K.

Figure 11:
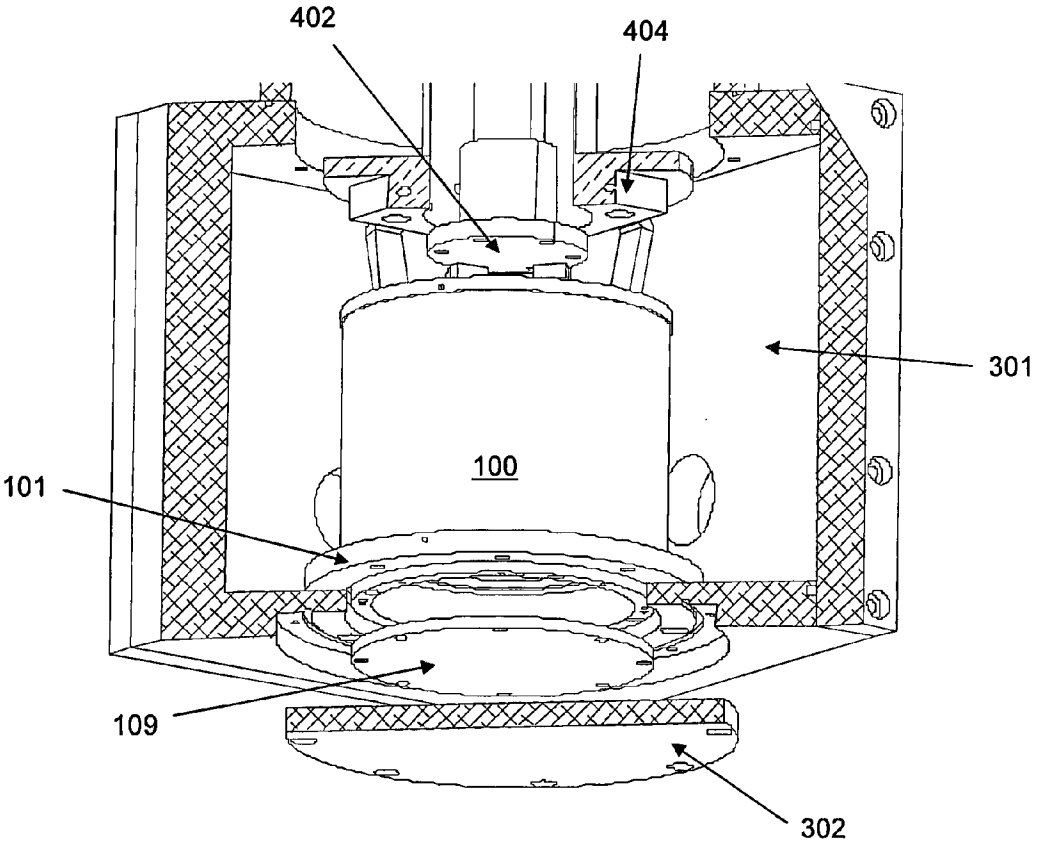

FIG. 11 is a view of the lower assembly, at an angle, so that the viewer can see the vacuum plate 302 taken off the bottom, showing the ease of access to the removable radiation shield 109.

FIG. 12 shows a view of the gap 700 between vacuum plate 302 and removable radiation shield 109. There is no physical contact between these two components, as if they touched a thermal short would cause a failure of the entire system thermally.

Thermal Model of Operation

Figure 13:
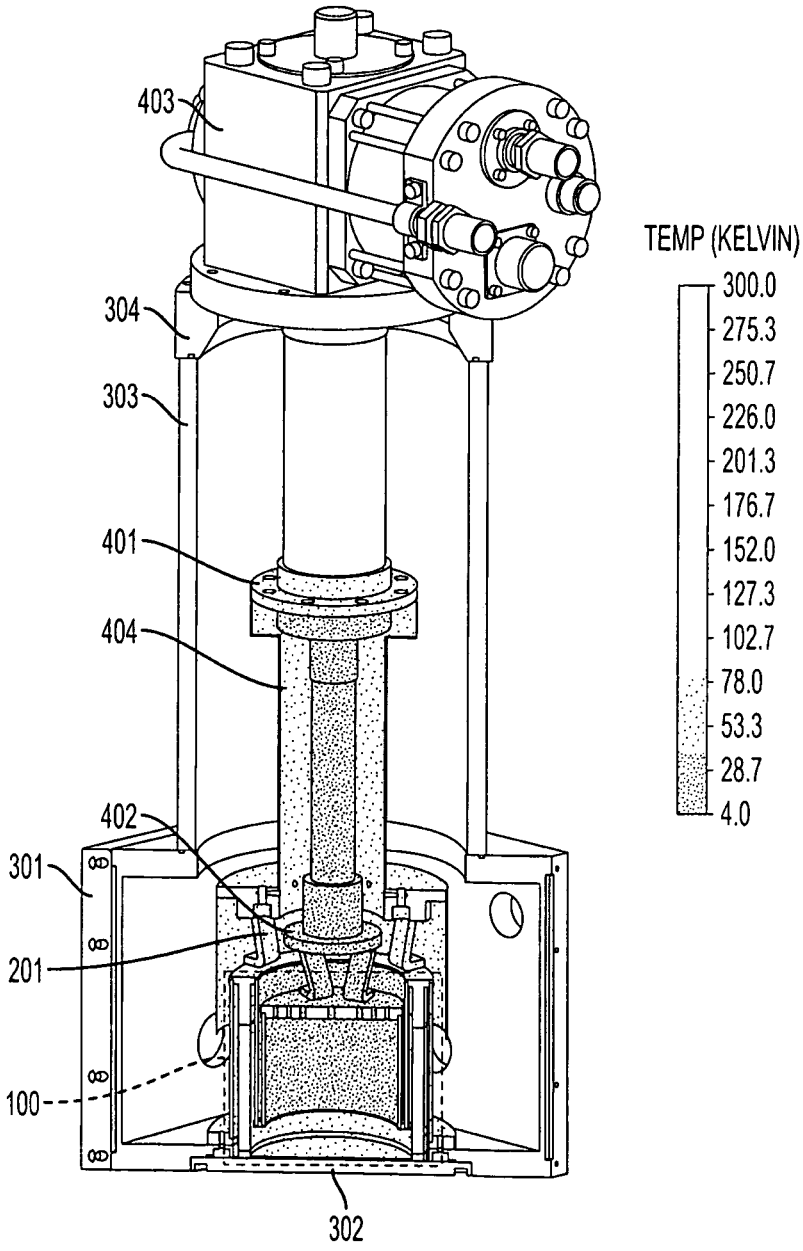
FIGS. 13 and 14 are gray-scale drawings showing a thermal model of a vibration isolated cryo-cooler according to an embodiment of the present disclosure where darker shades represents colder components, and lighter shades represent hotter components as per the scale on the right of FIG. 13.

To better understand the components that make up the disclosed system, a visual thermal model of the vibration isolated cryo-cooler is provided. This allows a visual description of the temperature of all components while operating at steady state. FIG. 13 shows a full thermal model of a vibration isolated cryogenic apparatus according to the present disclosure.

Figure 14:
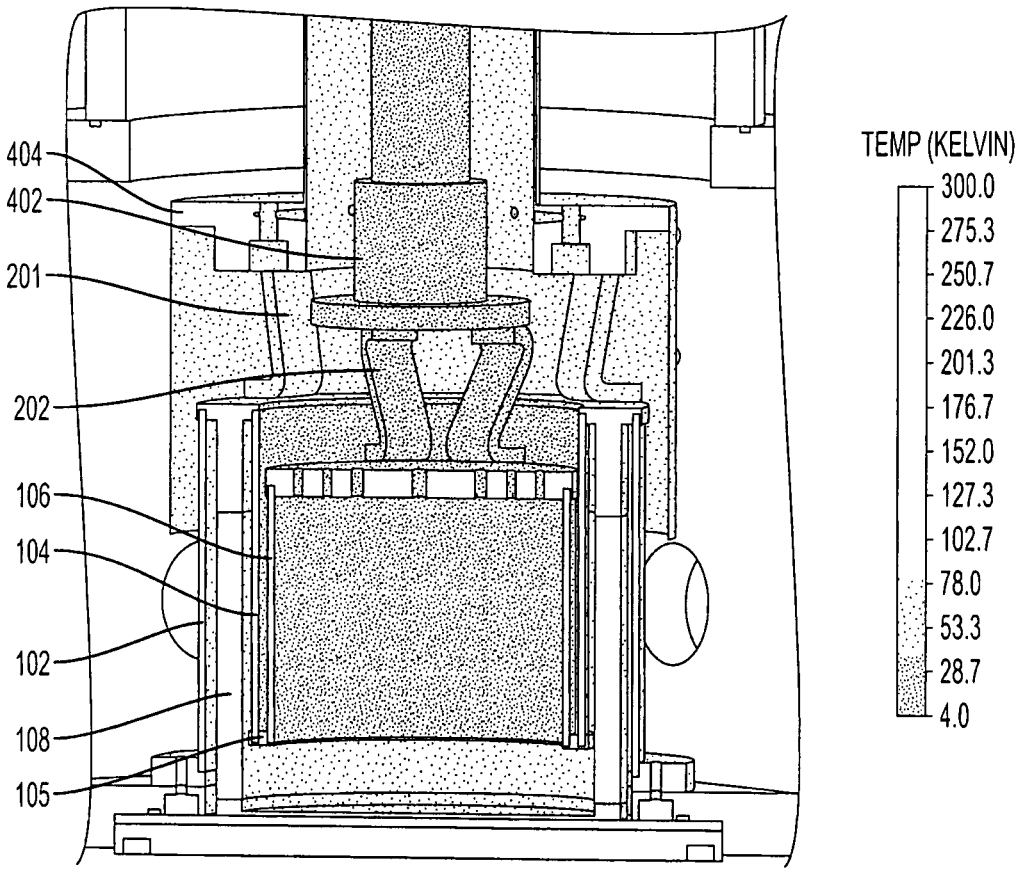

The components with the lightest color are at higher temperatures (300 K) while components with a darkest color are at cryogenic temperatures (4 K). FIG. 14 is a view of the NTIS. This view clarifies how parts interface in this complex part of the cryo-cooler. As can be seen in FIGS. 13 and 14, the parts at cryogenic temperatures are the low temperature cold finger 402 and the low temperature thermal link portion 202. Parts at intermediate temperature (i.e., >4K to 40K) are the high temperature cold finger 401, the cryo-cooler radiation shield 404, the high temperature thermal link portion 201 and the inner thermally insulated tube 106. The other portions of the apparatus are at greater than 40 K.

Various Designs for Top Bottom and Side Access to the Sample Space

Figures 15A, 15B, 15C:
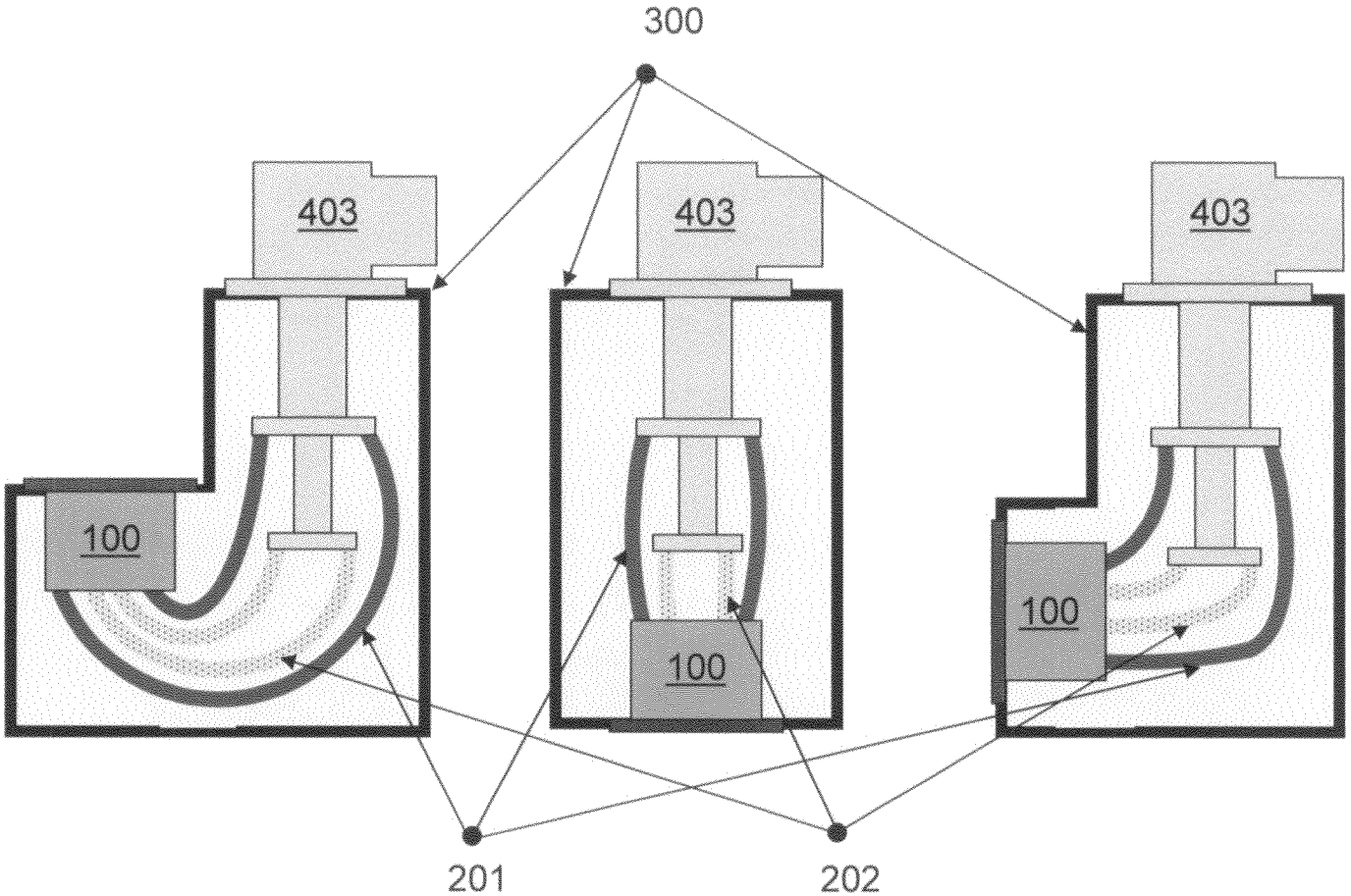
FIGS. 15A-C are cross-sectional views of embodiments of devices according to the present disclosure.
Figure 16A:
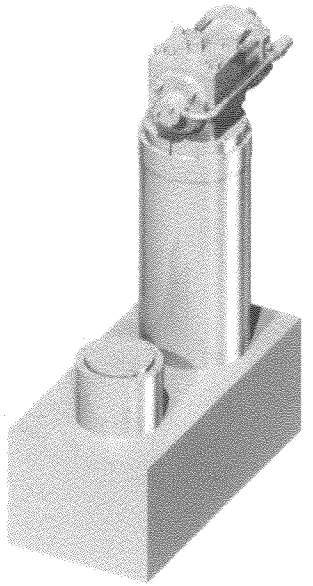
FIGS. 16A-C are perspective views of the devices of FIGS. 15A-C.
Figure 16B:
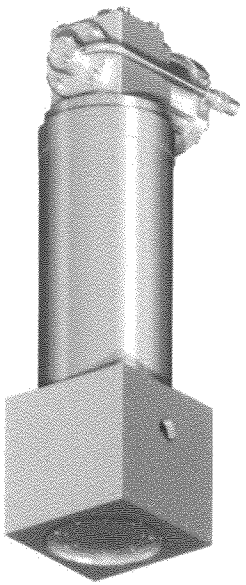
Figure 16C:
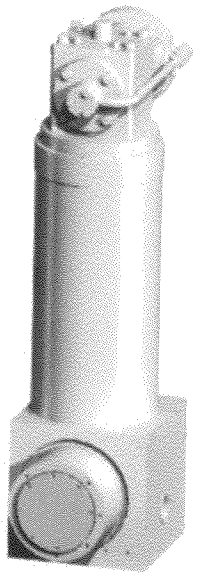

FIGS. 15A-C show various configurations of the present disclosure with access to the sample space from three different orientations. The different orientations allow for the sample to be accessed from either the top, side or the bottom of the cryostat. All of these orientations have pros and cons depending on the application. CAD models of these configurations when using a SHI cryo-cooler are shown in FIGS. 16A-C. These illustrations are shown as examples of use, and other multiple configurations are possible. These examples show the cryo-cooler in the upright configuration, which is typically the most efficient configuration, but other orientations of the cryo-cooler, including on it side or upside-down are also possible.

EXAMPLES

Vibration data is presented for both a Gifford-McMahon style cryo-cooler, specifically a SHI model RDK-101D cryo-cooler from Sumitomo Heavy Industries Cryogenics of America (Sunnyvale, Calif.) and a pulse tube cryo-cooler, specifically a Cryomech model PT-405 cryo-cooler from Cryomech Inc. (Syracuse, N.Y.) as each modified with parts as illustrated in FIGS. 5, 6, 7, 8, 10, 11. These modifications used a NTIS with three thermally insulting tubes, two tube couplers, Masterbond epoxy joints, a removable tubular radiation shield, a removable radiation shield plate, as well using flexible wire thermal links comprised of ~10,000 wires of 44 American Wire Gauge (AWG) OFHC copper, with forged ends. The difference between these two closed-cycle cryo-coolers is the mechanical cycle used to produce cooling.

Both of these use pressure cycles to produce cooling, however the pulse tube has no moving cold components while the Gifford-McMahon does have moving parts. Since the two cycles differ due to the presence or absence of moving parts these two systems have different frequency plots and therefore when combined with our vibration isolation system are useful for different frequency spectra depending on the application. The Gifford-McMahon (SHI RDK-101D) cryo-coolers tend to have less noise in the high frequency range above 50 Hz while the Pulse Tube (Cryomech PT-405) cryo-coolers tend to have less noise below 50 Hz.

Figure 17:
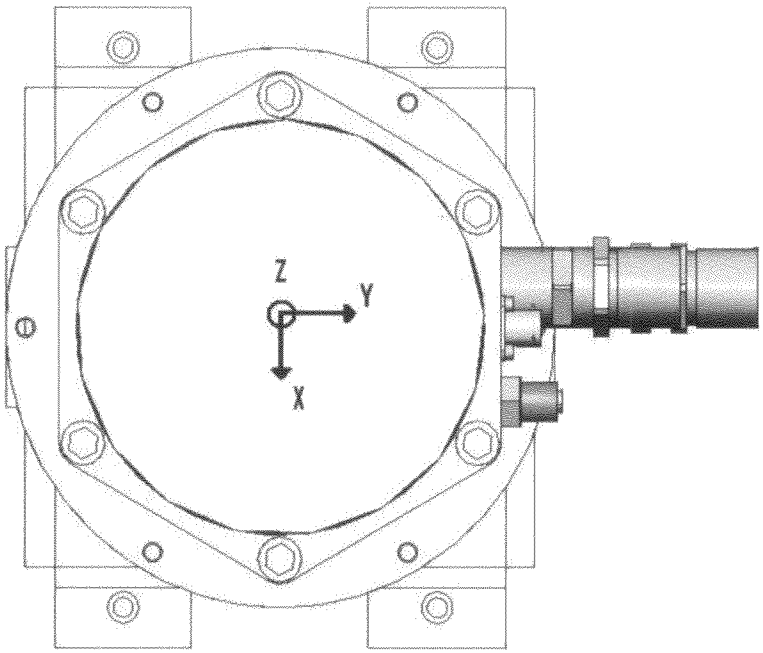
FIG. 17 shows the orientation of a cryostat relative to a vibration measurement direction.

FIG. 17 shows the orientation of the head with respect to all the vibration data taken. Data can be taken on the X, Y and Z data, and X data is shown as representative and is also the largest displacement observed.

Vibration data that was obtained on a vibration isolated SHI RDK-101D 4K cryo-cooler operating near 4K is shown. For the SHI RDK-101D 4K cryo-cooler, in summary, the results show a maximum vibration level of approximately 50 nm on the X axis at 1.4 Hz. Not shown are Y and Z data, which have approximately 20 nm on the Y axis at 1.4 Hz, and approximately 10 nm displacement at the same frequency, respectively.

Figure 18:
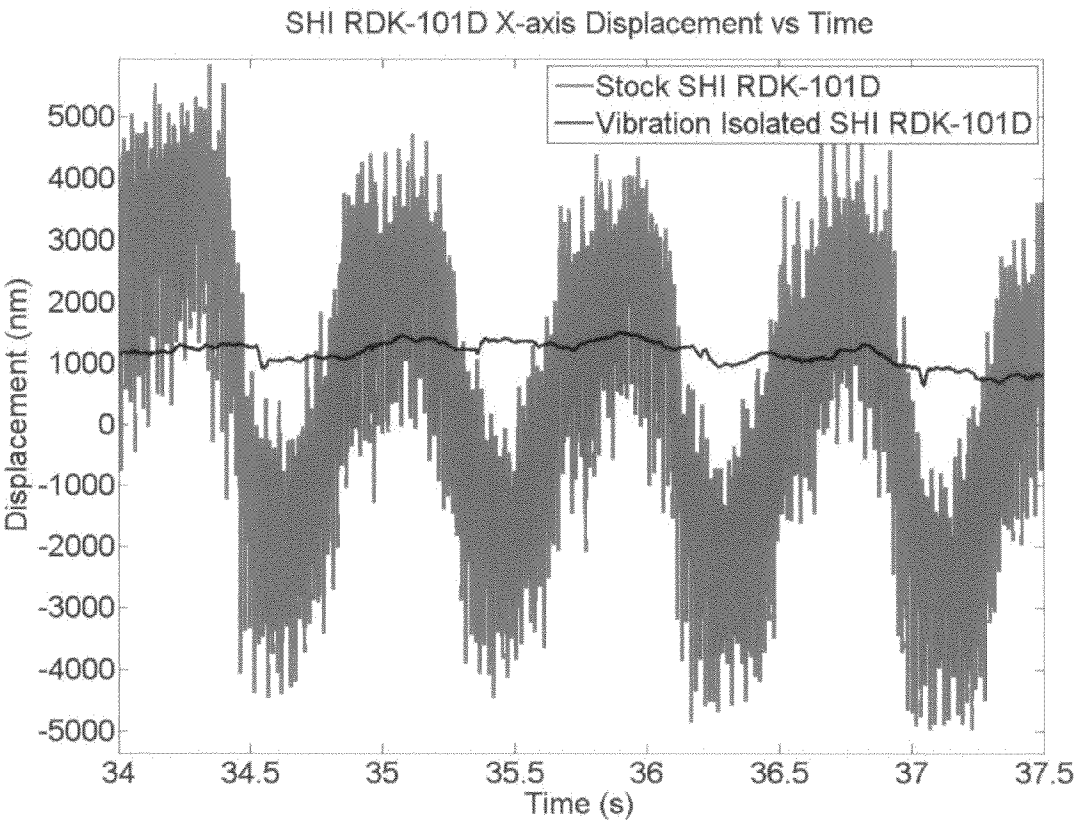
FIG. 18 shows experimental data of time dependent vibrations of a stock cryo-cooler and a vibration isolated cryo-cooler according to an embodiment of the present disclosure.
Figure 19:
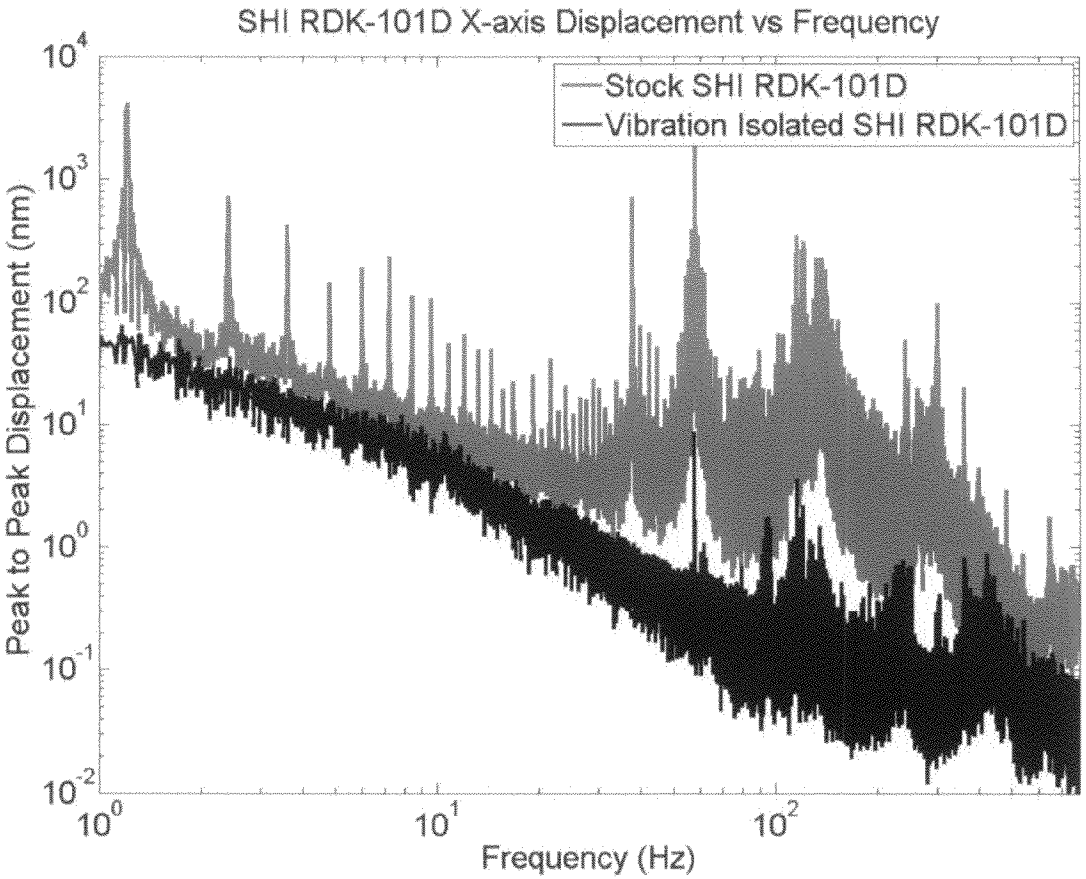
FIG. 19 shows experimental data of X-direction displacements of vibrations of a stock cryo-cooler and a vibration isolated cryo-cooler according to an embodiment of the present disclosure.

FIG. 18 shows the displacement of the sample holder of a stock SHI RDK-101D cryo-cooler along with the displacement of the sample holder of a vibration isolated SHI plotted against time or the X-axis. FIG. 19 shows vibration versus frequency plots for the X axis. This graph shows frequencies ranging from 1 Hz to 790 Hz. Data for a stock (unmodified) unit is shown for comparison on both graphs.

Representative data was also taken on a pulse tube Cryomech PT-405 cryo-cooler. Since there are no moving parts in this head more gas has to flow in order to fill and drain the head, therefore the high frequency noise is greater.

Figure 20:
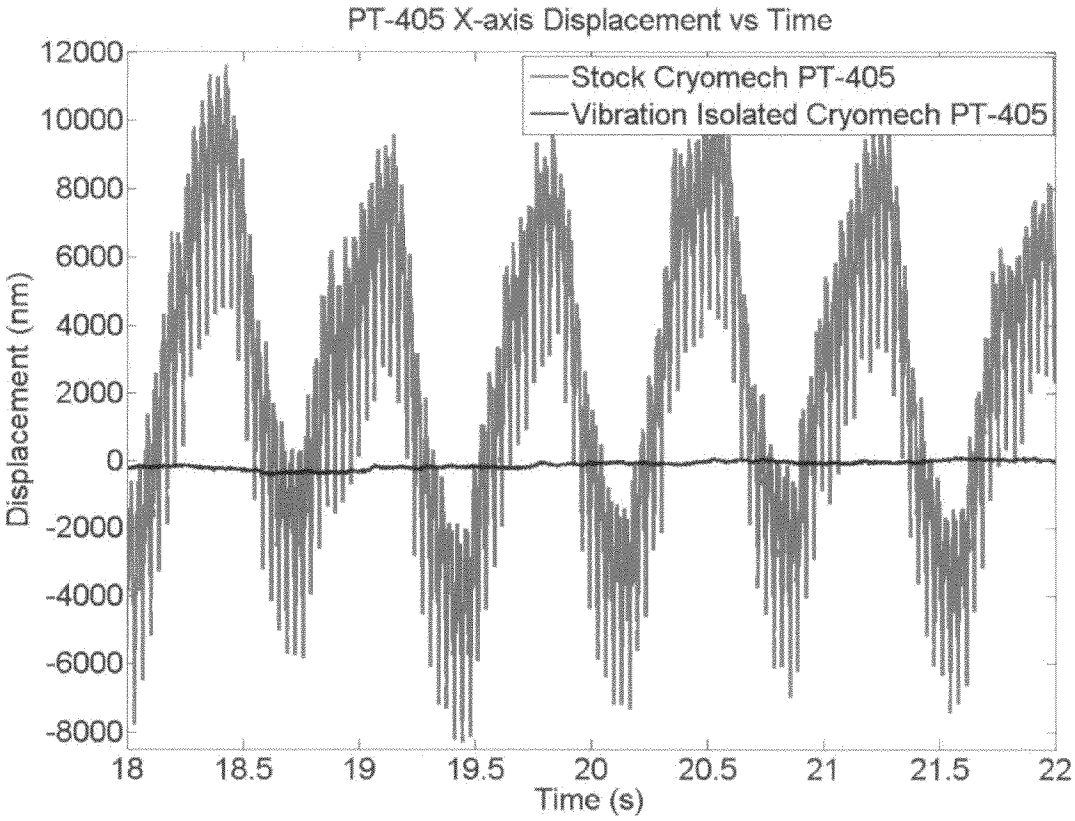
FIG. 20 shows experimental data of time dependent vibrations of a stock cryo-cooler and a vibration isolated cryo-cooler according to an embodiment of the present disclosure.
Figure 21:
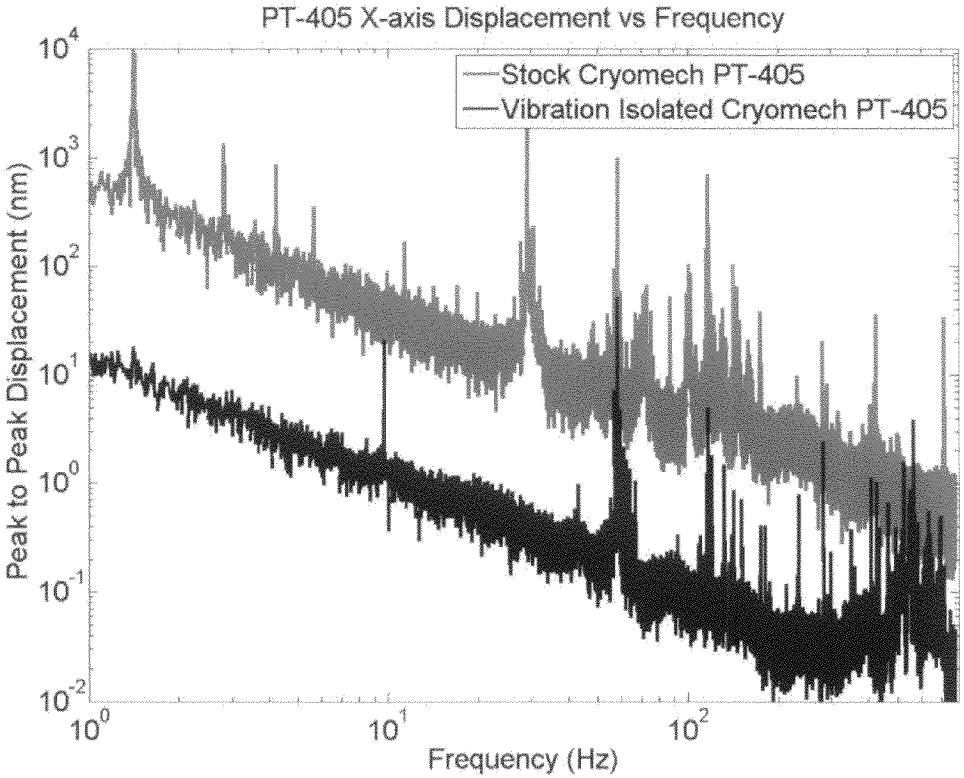
FIG. 21 shows experimental data of X-direction displacements of vibrations of a stock cryo-cooler and a vibration isolated cryo-cooler according to an embodiment of the present disclosure.

FIG. 20 shows a graph of the displacement versus time for a Cryomech PT-405 for the X-axis. FIG. 21 shows the X axis vibration displacement data versus frequency. This graph shows frequencies ranging from 1 Hz to 790 Hz. Data for a stock (unmodified) unit is shown for comparison on both graphs.

The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the disclosure. However, it should be recognized that the present disclosure can be practiced without resorting to the details specifically set forth. In other instances, well known processing structures have not been described in detail, in order not to unnecessarily obscure the present disclosure.

Only a few examples of the present disclosure are shown and described herein. It is to be understood that the disclosure is capable of use in various other combinations and environments and is capable of changes or modifications within the scope of the inventive concepts as expressed herein.

What is claimed is:

1. A cryogenic apparatus comprising:
- a nested thermally insulated structure for holding a sample to be cooled;
- a cryo-cooler;
- a thermal link connecting the nested thermally insulated structure and the cryo-cooler,
- a vacuum shroud encasing the nested thermally insulated structure, the cryo-cooler, and the thermal link; and
- a vacuum plate removably attached to the vacuum shroud.

2. The cryogenic apparatus of claim 1, wherein the nested thermally insulated structure comprises:
- a sample mount;
- a first tube coupler;
- a second tube coupler;
- an inner thermally insulated tube attached to the sample mount;
- a middle thermally insulated tube attached to the inner thermally insulated tube via the first tube coupler; and
- an outer thermally insulated tube attached to the middle thermally insulated tube via the second tube coupler,
- wherein the middle thermally insulated tube surrounds the inner thermally insulated tube such that a point midway between the top and bottom of the inner thermally insulated tube is disposed between the top and bottom of the middle thermally insulated tube, and
- the outer thermally insulated tube surrounds the middle thermally insulated tube such that a point midway between the top and bottom of the middle thermally insulated tube is disposed between the top and bottom of the outer thermally insulated tube.

3. The cryogenic apparatus of claim 2, further comprising:
- a mount flange attached to an outer surface of the outer thermally insulated tube.

4. The cryogenic apparatus of claim 2, wherein the inner thermally insulated tube, the middle thermally insulated tube and the outer thermally insulated tube comprise glass fiber and epoxy resin.

5. The cryogenic apparatus of claim 2, wherein the inner thermally insulated tube, the middle thermally insulated tube and the outer thermally insulated tube comprise at least one of carbon fiber, graphite, poly-N,N'-(p,p'-oxydiphenylene pyromellitimide), or polyaryletheretherketone.

6. The cryogenic apparatus of claim 2, wherein the sample mount comprises copper.

7. The cryogenic apparatus of claim 2, wherein the cryo-cooler comprises:
- a cold head;
- a high temperature cold finger in communication with the cold head;
- a low temperature cold finger in communication with the high temperature cold finger; and
- a cryo-cooler radiation shield,
- wherein the thermal link has a high temperature thermal link portion and a low temperature thermal link portion,
- the high temperature thermal link portion connects the second tube coupler with the high temperature cold finger;
- the low temperature thermal link portion connects the sample mount with the low temperature cold finger, and
- the cryo-cooler radiation shield connects the high temperature cold finger and the high temperature thermal link portion.

8. The cryogenic apparatus of claim 1, wherein said thermal link is for reducing vibration such that a peak corresponding to a repetition interval at which the cryo-cooler operates is lowered from 10 μm to 20 nm.

9. A cryogenic apparatus comprising:
- a nested thermally insulated structure for holding a sample to be cooled;
- a cryo-cooler; and
- a thermal link connecting the nested thermally insulated structure and the cryo-cooler,
- wherein the nested thermally insulated structure comprises:
- a sample mount;
- a first tube coupler;

a second tube coupler;

an inner thermally insulated tube attached to the sample mount;

a middle thermally insulated tube attached to the inner thermally insulated tube via the first tube coupler; and an outer thermally insulated tube attached to the middle thermally insulated tube via the second tube coupler, wherein the middle thermally insulated tube surrounds the inner thermally insulated tube such that a point midway between the top and bottom of the inner thermally insulated tube is disposed between the top and bottom of the middle thermally insulated tube, and the outer thermally insulated tube surrounds the middle thermally insulated tube such that a point midway between the top and bottom of the middle thermally insulated tube is disposed between the top and bottom of the outer thermally insulated tube, the cryogenic apparatus further comprising:

a vacuum shroud encasing the nested thermally insulated structure, the cryo-cooler, and the thermal link; and a vacuum plate removably attached to the vacuum shroud, wherein the nested thermally insulated structure and the vacuum plate form a sample chamber, and a volume of the sample chamber is not in fluid communication with a volume enclosed by the vacuum shroud, such that upon dispersal of the vacuum in the sample chamber, a vacuum is maintained in the area enclosed by the vacuum shroud.

10. The cryogenic apparatus of claim 9, further comprising a tubular radiation shield disposed between the outer thermally insulated tube and the middle thermally insulated tube, wherein the tubular radiation shield is attached to the second tube coupler.

11. The cryogenic apparatus of claim 10, wherein the tubular radiation shield is removably attached to the second tube coupler.

12. The cryogenic apparatus of claim 10, wherein the tubular radiation shield, the first tube coupler and the second tube coupler comprise aluminum.

13. The cryogenic apparatus of claim 10, further comprising a removable radiation shield removably attached to the tubular radiation shield, wherein the removable radiation shield is not in direct contact with the vacuum plate.

14. The cryogenic apparatus of claim 4, wherein a portion of the inner thermally insulated tube, a portion of the middle thermally insulated tube, a portion of the outer thermally insulated tube, and a portion of the tubular radiation shield are transparent to light.

15. A cryogenic apparatus comprising a nested thermally insulated structure, wherein the nested thermally insulated structure comprises:

a sample mount;

a first tube coupler;

a second tube coupler;

an inner thermally insulated tube attached to the sample mount;

a middle thermally insulated tube attached to the inner thermally insulated tube via the first tube coupler; and an outer thermally insulated tube attached to the middle thermally insulated tube via the second tube coupler, wherein the middle thermally insulated tube surrounds the inner thermally insulated tube such that a point midway between the top and bottom of the inner thermally insulated tube is disposed between the top and bottom of the middle thermally insulated tube, and the outer thermally insulated tube surrounds the middle thermally insulated tube such that a point midway between the top and bottom of the middle thermally insulated tube is disposed between the top and bottom of the outer thermally insulated tube, and wherein the cryogenic apparatus further comprises:

a vacuum shroud for encasing the nested thermally insulated structure; and a vacuum plate removably attached to the vacuum shroud.

16. The cryogenic apparatus of claim 15, further comprising a tubular radiation shield disposed between the outer thermally insulated tube and the middle thermally insulated tube, wherein the tubular radiation shield is attached to the second tube coupler.

17. The cryogenic apparatus of claim 16, further comprising a removable radiation shield removably attached to the tubular radiation shield.

18. The cryogenic apparatus of claim 15, wherein the inner thermally insulated tube, the middle thermally insulated tube and the outer thermally insulated tube comprise at least one of glass fiber and epoxy resin, carbon fiber, graphite, poly-N,N'-(p,p'-oxydiphenylene pyromellitimide), or polyaryletheretherketone.

19. The cryogenic apparatus of claim 15, wherein the sample mount comprises copper.

20. The cryogenic apparatus of claim 15, wherein the tubular radiation shield, the first tube coupler and the second tube coupler comprise aluminum.

21. The cryogenic apparatus of claim 2, wherein the first tube coupler, the second tube coupler, the inner thermally insulated tube, the middle thermally insulated tube, and the outer thermally insulated tube are attached with epoxy.

22. The cryogenic apparatus of claim 15, wherein the first tube coupler, the second tube coupler, the inner thermally insulated tube, the middle thermally insulated tube and the outer thermally insulated tube are attached with epoxy.

23. The cryogenic apparatus of claim 16, wherein a portion of the inner thermally insulated tube, a portion of the middle thermally insulated tube, a portion of the outer thermally insulated tube, and a portion of the tubular radiation shield are transparent to light.

24. A cryogenic apparatus comprising a nested thermally insulated structure, wherein the nested thermally insulated structure comprises:

a sample mount;

a tube coupler;

an inner thermally insulated tube attached to the sample mount; and an outer thermally insulated tube attached to the inner thermally insulated tube via the tube coupler, wherein the outer thermally insulated tube surrounds the inner thermally insulated tube such that a point midway between the top and bottom of the inner thermally insulated tube is disposed between the top and bottom of the outer thermally insulated tube, and wherein the cryogenic apparatus further comprises:

a vacuum shroud for encasing the nested thermally insulated structure; and a vacuum plate removably attached to the vacuum shroud.

25. The cryogenic apparatus of claim 24, further comprising a tubular radiation shield disposed between the outer thermally insulated tube and the inner thermally insulated tube, wherein the tubular radiation shield is attached to the tube coupler.

26. The cryogenic apparatus of claim 25, wherein the tubular radiation shield is removably attached to the tube coupler.

27. The cryogenic apparatus of claim 24, wherein the inner thermally insulated tube and the outer thermally insulated tube comprise at least one of glass fiber and epoxy resin, carbon fiber, graphite, poly-N,N'-(p,p'-oxydiphenylene pyromellitimide), or polyaryletheretherketone.

28. The cryogenic apparatus of claim 24, wherein the sample mount comprises copper.

29. The cryogenic apparatus of claim 25, wherein the tubular radiation shield and the tube coupler comprise aluminum.

30. The cryogenic apparatus of claim 25, wherein a portion of the inner thermally insulated tube, a portion of the outer thermally insulated tube, and a portion of the tubular radiation shield are transparent to light.

31. A cryogenic apparatus comprising:

a nested thermally insulated structure for holding a sample to be cooled;

a cryo-cooler;

a thermal link connecting the nested thermally insulated structure and the cryo-cooler, wherein the nested thermally insulated structure comprises:

a sample mount;

a first tube coupler;

a second tube coupler;

an inner thermally insulated tube attached to the sample mount;

a middle thermally insulated tube attached to the inner thermally insulated tube via the first tube coupler; and an outer thermally insulated tube attached to the middle thermally insulated tube via the second tube coupler, wherein the middle thermally insulated tube surrounds the inner thermally insulated tube such that a point midway between the top and bottom of the inner thermally insulated tube is disposed between the top and bottom of the middle thermally insulated tube, and the outer thermally insulated tube surrounds the middle thermally insulated tube such that a point midway between the top and bottom of the middle thermally insulated tube is disposed between the top and bottom of the outer thermally insulated tube, the cryogenic apparatus further comprising:

a vacuum shroud encasing the nested thermally insulated structure, the cryo-cooler, and the thermal link; and a vacuum plate removably attached to the vacuum shroud.

32. The cryogenic apparatus of claim 31, further comprising a tubular radiation shield disposed between the outer thermally insulated tube and the middle thermally insulated tube, wherein the tubular radiation shield is attached to the second tube coupler.

33. The cryogenic apparatus of claim 32, wherein the tubular radiation shield is removably attached to the second tube coupler.

34. The cryogenic apparatus of claim 32, wherein the tubular radiation shield, the first tube coupler and the second tube coupler comprise aluminum.

35. The cryogenic apparatus of claim 32, further comprising a removable radiation shield removably attached to the tubular radiation shield, wherein the removable radiation shield is not in direct contact with the vacuum plate.

* * * * *